US005511775A

United States Patent [19]

Parks

[11] Patent Number: 5,511,775

[45] Date of Patent: Apr. 30, 1996

[54] LOW REBOUND SPORTS TARGET

[76] Inventor: Alan D. Parks, 1351 Charlotte St., Altamonte Springs, Fla. 32701

[21] Appl. No.: 314,228

[22] Filed: Sep. 28, 1994

Related U.S. Application Data

[63] Continuation-in-part of Ser. No. 57,047, Apr. 30, 1993, Pat. No. 5,370,386.

[51] Int. Cl.[6] ..... A63B 69/00

[52] U.S. Cl. ..... 273/26 A; 273/400; 273/402

[58] Field of Search ..... 273/26 A, 396, 273/398, 400, 401, 402

[56] References Cited

U.S. PATENT DOCUMENTS

| | | | |
|---|---|---|---|
| 1,592,005 | 7/1926 | Rovane | 273/26 A |
| 2,059,365 | 11/1936 | King | 273/26 A |
| 2,126,102 | 8/1938 | Fowler | 273/26 |
| 2,201,865 | 5/1940 | Kriekard | 273/401 |
| 2,873,969 | 2/1959 | Ziel | 273/26 A |
| 2,988,360 | 6/1961 | Lambiotte | 273/26 A X |
| 2,992,002 | 7/1961 | Bingham, Jr. | 273/26 A X |
| 3,197,208 | 7/1965 | Makar | 273/400 X |
| 3,312,467 | 4/1967 | Dawson | 273/26 A |
| 3,408,071 | 10/1968 | Lundy | 273/26 A |
| 3,997,158 | 12/1976 | Britton | 273/26 A |
| 4,173,337 | 11/1979 | Okonowski | 273/26 A |
| 4,188,031 | 2/1980 | Fox | 273/26 A |
| 4,210,326 | 7/1980 | Booth et al. | 273/26 A |
| 4,254,952 | 3/1981 | Playter, Jr. | 273/26 A |
| 4,295,648 | 10/1981 | Stromback | 273/26 A |
| 4,497,485 | 2/1985 | Macosko | 273/26 A |
| 4,781,376 | 11/1988 | Barnes, Sr. | 273/26 A |
| 4,783,070 | 11/1988 | Bauer et al. | 273/26 A |
| 4,842,283 | 6/1989 | LeBel et al. | 273/392 |
| 4,863,166 | 9/1989 | Becera et al. | 273/26 A |
| 4,905,996 | 3/1990 | Tallent et al. | 273/26 A |
| 4,932,657 | 6/1990 | Hailer et al. | 273/26 A |
| 5,064,194 | 11/1991 | Bixler et al. | 273/26 A |
| 5,083,774 | 1/1992 | Yalvac | 273/26 A |
| 5,242,160 | 9/1993 | Girard et al. | 273/26 A |
| 5,271,616 | 12/1993 | Grimaldi | 273/26 A |
| 5,348,291 | 9/1994 | Scully | 273/26 A |

*Primary Examiner*—William H. Grieb

*Attorney, Agent, or Firm*—Allen, Dyer, Doppelt, Franjola & Milbrath

[57] ABSTRACT

A low rebound sports target useful in baseball pitching and fielding drills freely suspends horizontal and vertical elements for defining target zones wherein the elements are able to absorb the energy delivered by a high speed baseball tossed at the target and provide for rebounding of the ball from the target in a safe manner with regard to concerns by a player using the target. A target comprising vertical chains and horizontal rods freely suspended in a spaced relation to a frame holding the chain is described. Tubing sections provide shrouds for the chain and rods while also providing for easy adjustment of the target in creating various target zones. Further, a bag collects successful target hits while a netted backstop collects errant tosses by the player. A support used in suspending target elements further provides for suspending sports images useful for simulating realistic game conditions.

31 Claims, 15 Drawing Sheets

LOW REBOUND SPORTS TARGET

CROSS REFERENCE TO RELATED APPLICATIONS

This application is a continuation-in-part application of application Ser. No. 08/057,047 now U.S. Pat. No. 5,370,386, for a sports training target and method filed on Apr. 30, 1993, commonly owned with the present invention.

BACKGROUND OF INVENTION

1. Field of Invention

The present invention relates to sports training devices and in particular to a target for safely developing accuracy and technique when an object such as a baseball is delivered to the target at a high speed, while having the object rebound without concern for injury to the player.

2. Background of Related Art

There exists a variety of targeting devices useful in various sports for improving ball throwing, kicking or hitting accuracy. It appears however that few such devices can be safely used at close range, especially in sports such as baseball, where ball speeds may exceed 90 miles per hour.

Training devices using pitching strings are well known and include horizontal and vertical strings in combination defining a strike zone as is described in *The Baseball Handbook for Coaches and Players* by Jim Depel, published in 1991 by Collier Books or as described in U.S. Pat. No. 3,312,467 issued on Apr. 4, 1967 to B. D. Dawson for a *Baseball Pitcher's Practice Device.* As described in the Dawson '467 disclosure, the strike zone is a vertical, rectangular area of a given width and adjustable height normally defined by the distance between the knees and shoulders of a baseball player at bat. The Dawson invention was formed by an elastic cord material wherein the ends of the horizontally extending upper and lower cords looped about upright frame members so that they could be moved in a vertical direction along the upright members to vary the overall height of the strike zone. The rectangular area defined by the cords was flexible so that a baseball striking a cord would push the cord to one side without appreciably deflecting the baseball. Vibration of the cord indicated that it was hit by the baseball. Tubular members provided a basic rectangular frame to which the elastic cords were attached.

In the U.S. Pat. No. 3,997,158 issued on Dec. 14, 1976 to H. B. Britton, a strike zone target is formed from two vertical chains spaced wider than home plate and two horizontal chains with a hook at each end, which hooks are adapted to be removably fastened at different heights to the vertical chains for drawing these vertical chains together to define the strike zone area. Britton '158 describes the target as being fastened to a wall or other structure but preferably attached to a frame which is erected in a suitable place and provided with attachments for batting practice. Britton further teaches that the target is preferably mounted in front of a back stop, usually vertical, which causes the return of the ball after it has passed the target. Britton further states that a pitched ball is considered a strike if any part of it passes over home plate which is seventeen inches wide and therefore, the strike zone will normally be somewhat more than seventeen inches wide, for example about twenty-two inches wide, so that if any part of the pitched ball passes over home plate it will enter the strike zone without touching either of the vertical chains. If the ball hits a chain that defines the strike zone, the chain vibrates and it is clear that the thrown ball is not a strike. Further, by the distance the ball rebounds from concrete or brick back stops, and less easily with a back stop that is not so hard, it can be readily determined whether a fast ball or slow ball has been thrown because of the distance the ball rebounds after the hitting the back stop. The vertical chains are held by hooks maintained taut by springs.

In U.S. Pat. No. 2,126,102, issued to R. A. Fowler on Aug. 9, 1938, a baseball pitching target comprising a rigid frame suspends a target having an aperture defining an area equivalent to a strike zone. The target is made of flexible chain covered with yieldable rubber tubing and is made taut by tightening turn buckles affixed between the target and the frame. The rectangular target is further divided into open areas to subdivide these strike zones for use in practicing various pitches well known in the sport.

U.S. Pat. No. 4,863,166 issued on Sep. 5, 1989 to S. J. Becera et al. discloses a throwing target for arresting the flight of a ball. The target comprises a frame for defining a vertical plane with a top rail spaced apart from a bottom rail, first and second linkages coupled between the top rail and the bottom rail and traversally adjustable relative to each other and to the frame. A deformable band is releasably coupled to the first and second linkages for expanding and contracting to form a plurality of rectangular target regions having a variety of selectable cross sectional areas and positioned relative to the frame depending in part upon the relative position of the first and second linkages and in part upon the location along the first and second linkages at which the deformable band is releasably coupled. A ball pouch is coupled to, and substantially rearward of, the deformable band for arresting the flight of balls thrown through the deformable band, wherein balls thrown on target are captured in the ball pouch and segregated from balls thrown off target.

In U.S. Pat. No. 4,905,996 issued on Mar. 6, 1990, D. P. Tallent et al. discloses a ball and target net game apparatus wherein a target net includes a perimeter frame work securing a generally planar net wherein the frame work includes a plurality of forwardly extending horizontal legs and associated bracing to maintain the netting in a secure arrangement during use. The framework and the legs of the apparatus are telescoping to effect a compact structure easily stored when not in use. An entering net is securely secured to spaced elongated straps longitudinally secured relative to the main net portion of the apparatus to provide a target in variable orientation relative to the main net.

Although the art appears to have a number of target devices, the needs identified for targets used in professional sports especially have not been satisfied. In particular, with baseball pitching speeds reaching and exceeding 100 miles an hour, a tremendous amount of energy is being delivered to the target. If the strike zone is missed, the target and the baseball can be damaged especially after many hits by the ball. In addition, there is a constant threat that a rebounding ball will be reflected back at the player possibly causing injury and certainly causing a distraction so as to take away from an effective skills training session. Further, since practice sessions are often held indoors or in close quarters, the need for a low rebounding sports target is easily appreciated.

Safe close range use requires controlled rebound from all possible impact points on the device being used. Devices disclosed in the art fail to provide the structural elements to control rebound. Typical targets comprise rigidly mounted support frame members with exposed portions of the frame structure supporting the target elements, in movably mounted rigid elements subject to impact by the oncoming ball, target or frame elements constructed of normally flexible and yielding materials such as rope, cable, or chain where such flexibility is nullified by having the materials restrained at both ends, or targets that are attached to a preexisting structure such as a wall where such structure is exposed and receives the oncoming ball.

It would therefore be desirable to have a sports target which can be easily and safely used at close range. Such a device would be useful where space is a consideration or where specific types of use or drills are a benefit at such close ranges. Other benefits derived would include improved visibility and ball collection. The sports target of the referenced application was developed to satisfy these needs.

A multi-shuttered target trainer as described in the referenced application meets the requirements for safe, close range use since all exposed impact surfaces consist of freely suspended flexible sheets of rubber. However, although multiple target zones were presented in various embodiments of the target trainer, the number of zones was limited since the shutters create areas of exclusion. Such exclusion areas repelled, stopped, or rebounded incoming balls to a safe location. Such exclusion areas did not provide narrow exclusion borders or boundaries lines which only alter a ball's trajectory when directly impacted by the ball. A hanging section of chain, by way of example, constitutes a border, while a piece of plywood or rubber sheet constitutes the exclusion area. Although both provide features useful in training, a target employing multiple border elements as opposed to multiple shutter elements provides the user with a finer and more flexible delineation of target areas while being less complex and expensive to construct as well as simpler to operate. The fine delineation of bordering regions as supported by the description in the referenced patents given by way of example, provide valuable measurements in any training device. Further, the smaller the ball, the smaller the defining borders must be in order for the user to distinguish exact impact locations especially at high incoming speeds. For example, an effective border width of twice a ball's diameter is of little use to the user when placement variations of one ball diameter or less are critical in a game. A half inch is often the difference between a strike and a ball in the game of baseball. The phrase "effective border width" is used to provide an improved definition of a border as used in various target devices. The term border could have several meanings: a border can be a line on a flat surface; it can be a distinct element such as a section of chain or bar; or any combination. Painted lines are adequate for some sports such as darts or arrows but when rebounding occurs they are less helpful to the observer than physically distinct borders which provide locational information by changing the trajectory of the ball within a narrow band.

It is for this reason, for example, that cloth banners with target markings are usually less than satisfactory targets for most users. Finally, a further advantage of the narrow border marker lies in the fact that objects missing the border or grazing it can pass through the target plane on either side of the border. This can be a big advantage when the targeting device includes collection means and storage of balls which successfully pass through the target plane as earlier described. Based on this, the multi-shuttered, low rebound sports target apparatus described in the above-referenced application can be improved by providing low rebound multiple border elements to replace the low rebound shutters. Such a device has been successfully designed and tested and represent the teachings of the present invention.

Various problems had to be solved in the development of the present invention. The teachings of the above-referenced copending application were beneficial in developing a low rebound sports target as is described in the accompanying sections of this specification.

SUMMARY OF INVENTION

The present invention relates to a low rebound sports target for safely developing accuracy and technique for a player using the target under various conditions demanded by the sport being played. In one embodiment of the present invention, a sports target comprises a support, an elongated vertical member having a top end hingedly affixed to the support for freely suspending the member from the support. The vertical member is uniformly resilient in order to receive an object such as a baseball delivered to the member by a player. The elongated vertical member sufficiently absorbs energy of the object through its free suspension of the member and limits rebounding of the object from the member to a safe position relative to the player. Further, the target comprises a flexible tubing having a bore dimensioned to receive the member. The tubing covers the member along a substantial portion of the member and is sufficiently flexible for receiving the object a multiplicity of times for providing effective reuse of the object by the player. Further, the tubing provides a visual feedback response to the player when hit by the object. In alternate embodiments, a single target element or target element array is affixed to the vertical member for simulating various target zones.

In a second embodiment of the sports target, a pair of elongated spaced apart vertical resilient members are freely suspended from a support. A pair of elongated spaced apart horizontal resilient members are each affixed to the vertical members to form an aperture to which an object can pass. The horizontal members are sufficiently rigid in a vertical dimension for holding a fixed shape for aperture side portions and are sufficiently resilient for receiving the delivered object and in combination with free suspension of each horizontal member with a freely suspended vertical members absorb the energy of the object and limit rebounding of the object from the horizontal or vertical members to a safe position relative to a player using the target.

In preferred embodiments of the present invention, the vertical members comprise chains and the horizontal members comprise flat, spring steel rods. Both the horizontal and vertical members are encased by tubular sections closely receiving the members. In an alternate embodiment, a bag having an opening defined by a perimeter portion of the bag communicates with the aperture for receiving and collecting objects passing through the aperture.

In yet another embodiment, the low rebound sports target comprises a support having a base and support members affixed to the base at one end and support the chain at the other end. The support members are dimensioned for receiving and freely suspending the chain in a spaced relation with the support members in a direction toward the player. The chain is positioned between the object tossed at the target by the player and the support members. The support members further have a separation between each member proximate a width dimension of the aperture whereby the target vertical members generally receive objects thrown at the target while substantially preventing the objects from directly hitting the support members.

It is a primary object of the present invention to provide a sports target for safe use at close ranges. Further, it is an object of the invention to provide controlled rebounding of a ball hitting the target. The hit target is to provide a visual feedback to the player. It is also an object of the present invention to collect rebounded balls wherein those comprising a successful hit of the target are collected in one area while errant balls are collected in another.

It is a further object of the present invention to provide target zone delineation with a target that is easy to operate and inexpensive to produce when compared to targets well known to the art. Specifically, such targets must be provided that can withstand balls impacting the target at speeds close to 100 miles per hour. It is further an object to provide elements of the target with sufficient mass and suspension to absorb the energy of such a high speed baseball and rebound the baseball to a location and with a speed that is safe for a player using the target. Such target elements must interact with the ball in such a way that multiple uses of the ball are possible. Finally, it is an object of the present invention to provide such a low rebound sports target that is portable in the sense of being easy to relocate from position to position for operation of the target and for storage of the target when not in use.

With regard to a support for the target, it is an object of the invention to provide such a support that along with the target has a portable frame work for suspending the target between a ball tossed at the target and the frame. It is further an object of the invention to provide a target aperture for pitching drills in baseball wherein outer vertical elements can be placed outside the typically seventeen inch homeplate width in such a fashion that pitched balls hitting portions of the elements will impact the elements so that their rebounding trajectory takes them through the aperture. Further, it is an object of the present invention to provide ease of adjustment of aperture dimensions where varying sizes of the aperture lend themselves to specific training drills.

BRIEF DESCRIPTION OF DRAWINGS

Preferred embodiments of the present invention as well as alternate embodiments are described by way of example with reference to the accompanying in which.

DETAILED DESCRIPTION OF PREFERRED EMBODIMENT

I. Detailed Description of Embodiments of Present Invention

Figure 1A:
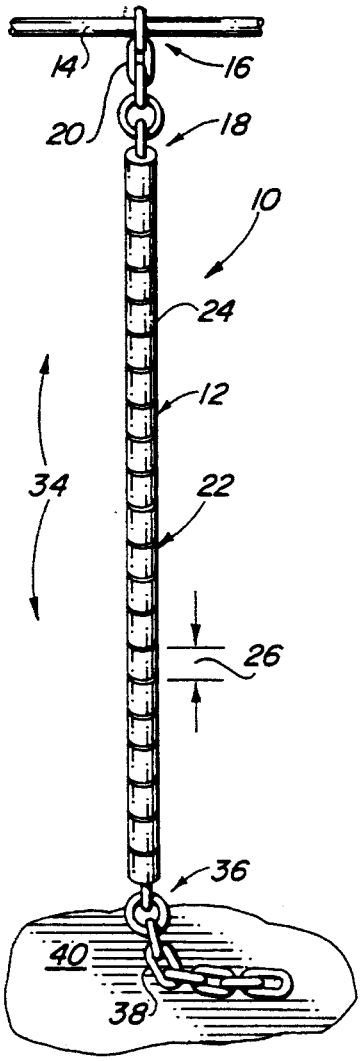
FIG. 1*a* is a front perspective view of one embodiment of the low rebound sports target of the present invention.
Figure 1B:
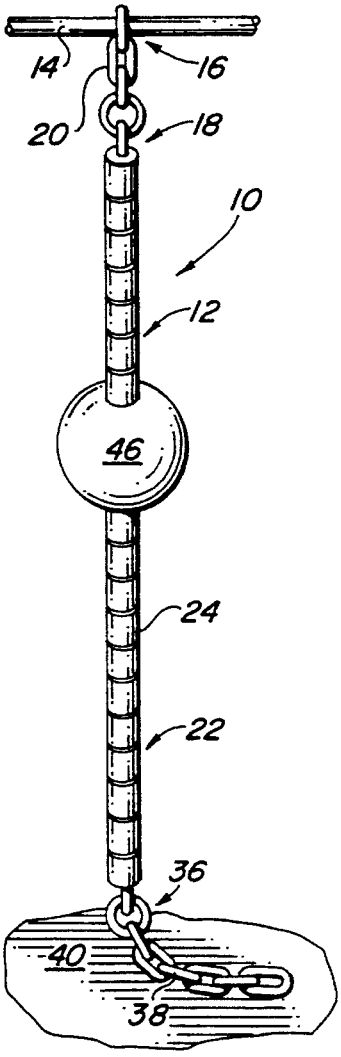
FIG. 1*b* is a front perspective view of the target illustrated in FIG. 1*a* including a target element.

With reference to FIG. 1*a*, an embodiment of the present invention, a low rebound sports target 10 comprises an elongated vertical member 12 affixed to a support 14 at a member top end 16 for freely suspended the member 12 from the support 14. The elongated vertical member 12 must be uniformly resilient for receiving an object such as a baseball thrown or hit at the member 12 by a player. It is anticipated that a variety of materials such as rope, cable and the like may be used for the member 12. In the preferred structure of the embodiments of the present invention, a chain 18 having multiple links 20 is used. Further, as illustrated with reference to FIG. 1*a*, tubing 22 provides a shroud for the chain and in the embodiments of the present invention, the tubing 22 comprises a multiplicity of tubing sections 24.

In the preferred embodiments of the invention, the chain 18 is encased in a multiplicity of short tubing sections 24 wherein each section 24 has a tubing section length 26 not exceeding a length 28 of a chain link 20. Further, as illustrated with reference to FIG. 2, the tubing section 24 comprises a tube wall 30 defining a bore 32 wherein the bore 32 closely receives the chain link 20.

Figure 2:
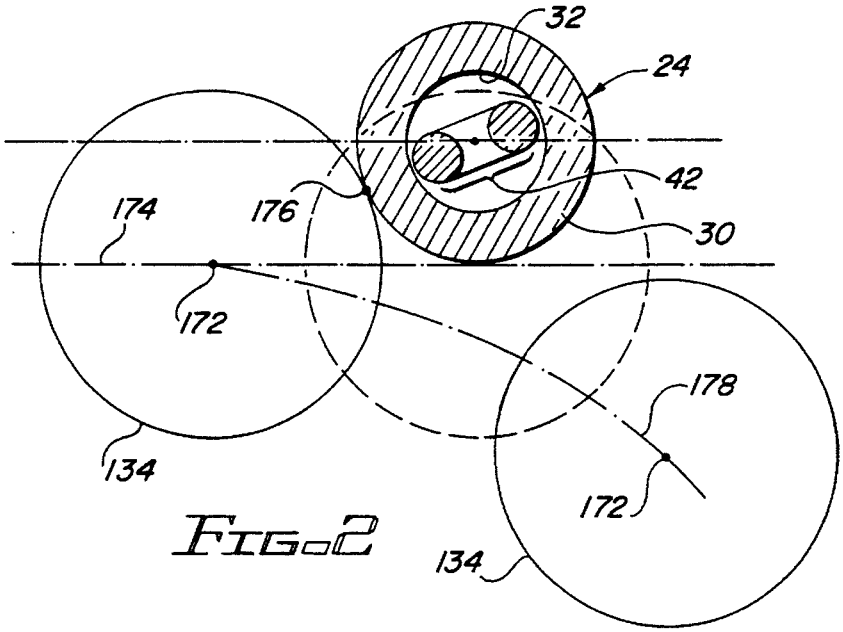
FIG. 2 is a partial cross-sectional view of a tubing section including a chain link within the tubing section bore illustrating by way of example a rebounding path of an object such as a baseball striking the tubing section.
Figure 3:
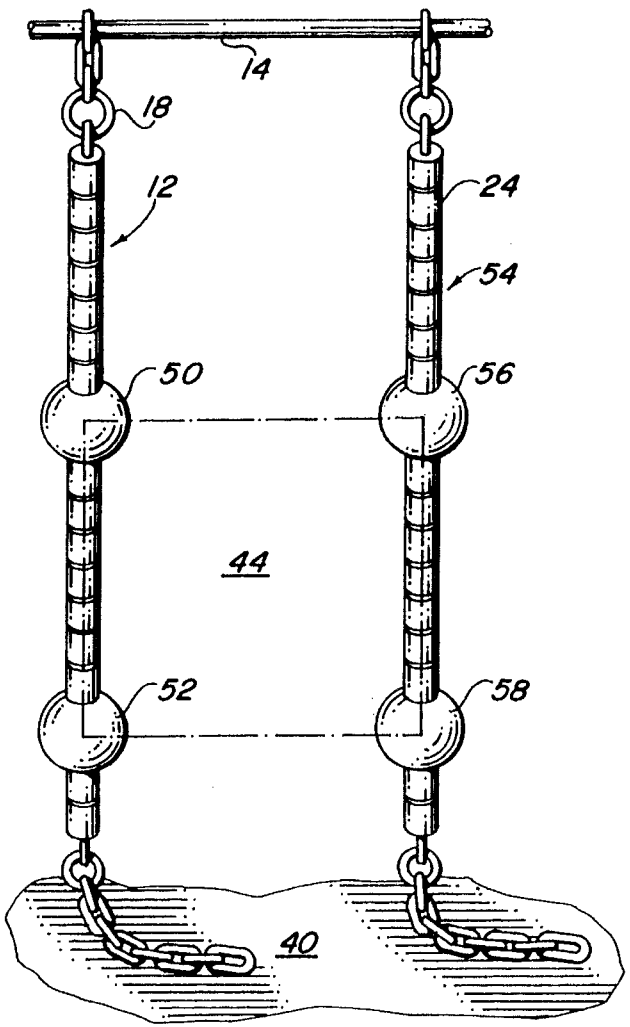
FIG. 3 is a front perspective view illustrating the use of a combination of targets described in FIG. 1C.

Again with reference to FIG. 1*a*, the sports target 10 further comprises the chain 18 having an overall length 34 such that when the chain 18 is suspended from the support 14, a chain bottom portion 36 comprises links 38 resting on a surface 40 over which the target 10 is positioned. With such an arrangement, the freely suspended elongated vertical member 12 comprising the chain 18 encased by the tubing sections 24 absorbs energy of an object tossed at the member with a further absorption or damping effect of the member 12 because of those chain links 38 resting on the surface 40. Further, by providing the tubing bore 32 with such a dimension as to closely receive the chain links 20 across a width 42 of the chain link 20, as illustrated in FIG. 2, a generally smooth or uniform tubing 22 is provided along the transition from tube section to tube section 24. With such a smooth transition, this continuity between tube sections 24 are minimized and an object rebounding off of the tubing 22 will experience a generally consistent rebound. As will be addressed later in this specification, such a consistent rebounding of an object striking the vertical member 12 provides benefits when such a member 12 is part of a target zone 44 as will be described with reference to FIG. 3.

With reference to the tube 22, rubber or plastic tubing has been shown to be effective in preventing damage to baseballs thrown at the target 10. In an alternate embodiment, a continuous length of tubing 22 was used for the elongated vertical member 12 and was shown to have an energy absorbing and damping effect appropriate for the intended use of the sports target 10. As was described in the summary section of the specification, a primary object of the present invention is to provide a target for safe use at close range. The configuration as described, and as will be described in the balance of the detailed description, provides a target 10 that will absorb the energy delivered to the target 10 by an object directed at the target 10. To meet this safe use objective of the invention, and by way of example, it is important that the elongated vertical member 12 receive a baseball travelling at approximately 90 miles per hour and rebound off of the member 12 with reduced energy or velocity to deliver the baseball to a safe position. Such a safe position may be defined as a location distant from a player delivering the baseball or if proximate the player with such low velocity or energy to be of no consequence with respect to injuring the player. As will be described later in the specification, close range pitching drills can therefore safely be performed. In addition, the target provides a sufficient reduction in the speed of rebound or bounce back of a baseball at impact that full speed pitching from close range becomes possible. By way of example, being able to reduce the normal pitching distance of approximately 60 feet to a close range pitching distance of approximately 15 feet reduces the amount of area needed for practice drills and provides an opportunity for a training format that offers a number of special drills as well as indoor pitching and efficient outdoor use of field space.

To accommodate the various drills anticipated when using the present invention, a target element 46 is affixed to the vertical member 12 for providing a cross sectional surface 48 generally larger than a cross section of the vertical member 12. With such an arrangement, an object can be directed at various portions of the target element 46 and the motion of the target element 46 in combination with the vertical member 12 when hit by the object will provide a visual feedback to the player for measuring success in his practice drill.

Figure 1C:
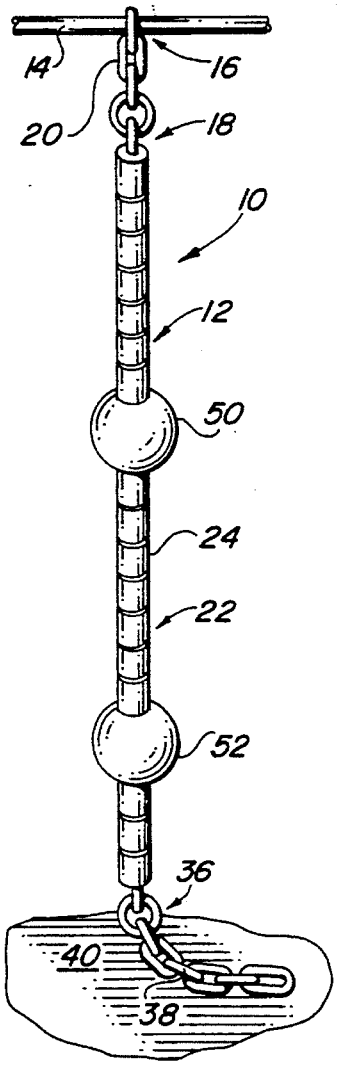
FIG. 1*c* is a front perspective view of the target of FIG. 1A including multiple target elements.

In an alternate arrangement, and with reference to FIG. 1*c*, additional target elements 50 and 52 are slidably affixed at preselected locations along the elongated vertical member 12. With such an arrangement, and a duplication of this arrangement as illustrated with reference to FIG. 3, a second vertical member 54 and second additional target elements 56 and 58, the target element 50, 52, 56 and 58 are spatially positioned to define corners of the target zone 44. Such an arrangement presents a novel representation of the target zone 44 and has proven to be effective in perfecting pitching skills of a player.

Figure 4C:
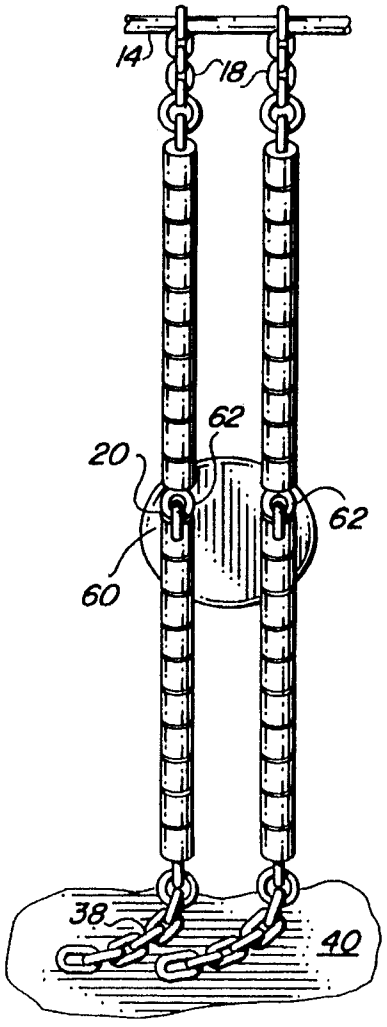
FIGS. 4*a*, 4*b* and 4*c* are front, side and back perspective view, respectively illustrating the use of the target of FIG. 1*a* in combination with an alternate target element.
Figure 4B:
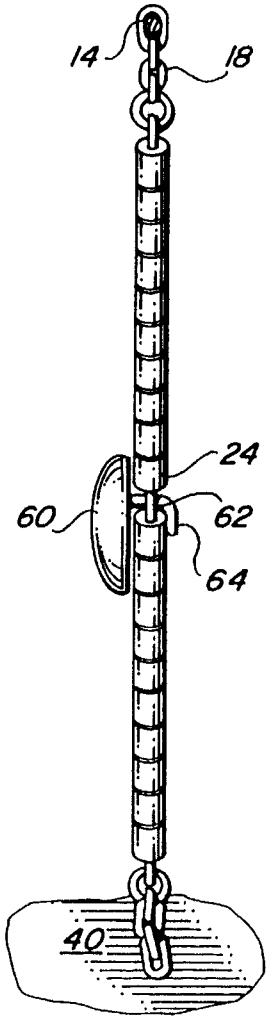
Figure 4A:
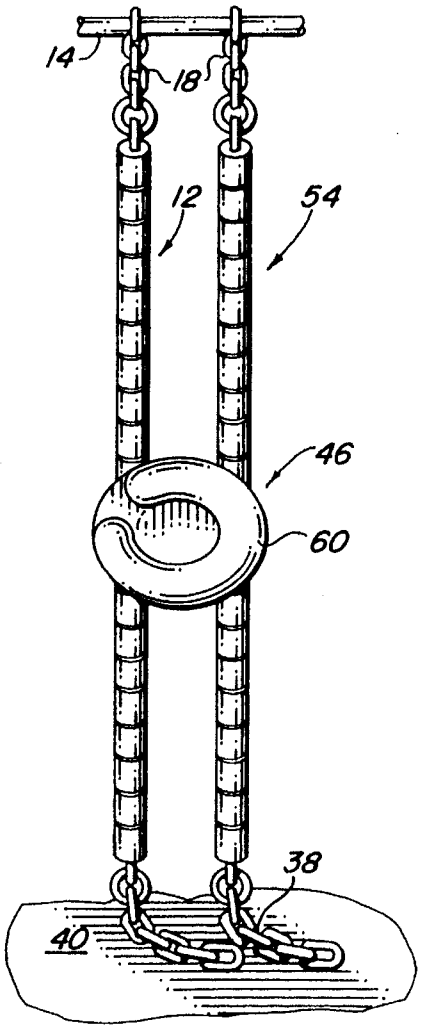

With reference to FIGS. 4*a* through 4*c*, an alternate embodiment of the target element 46 takes on the shape and image of a catcher's mit 60. The catcher's mit 60 is removably attached to corresponding chain links 62 by any well known attachment means 64 at a predetermined height 66 above the surface 40. Tube sections 24 proximate the attachments means 64 are separated from each other by sliding the tube sections 24 along the chain 18. The catcher's mit 60 has a cross section as viewed by the player sufficient to cover any exposed chain links 20.

Figure 5A:
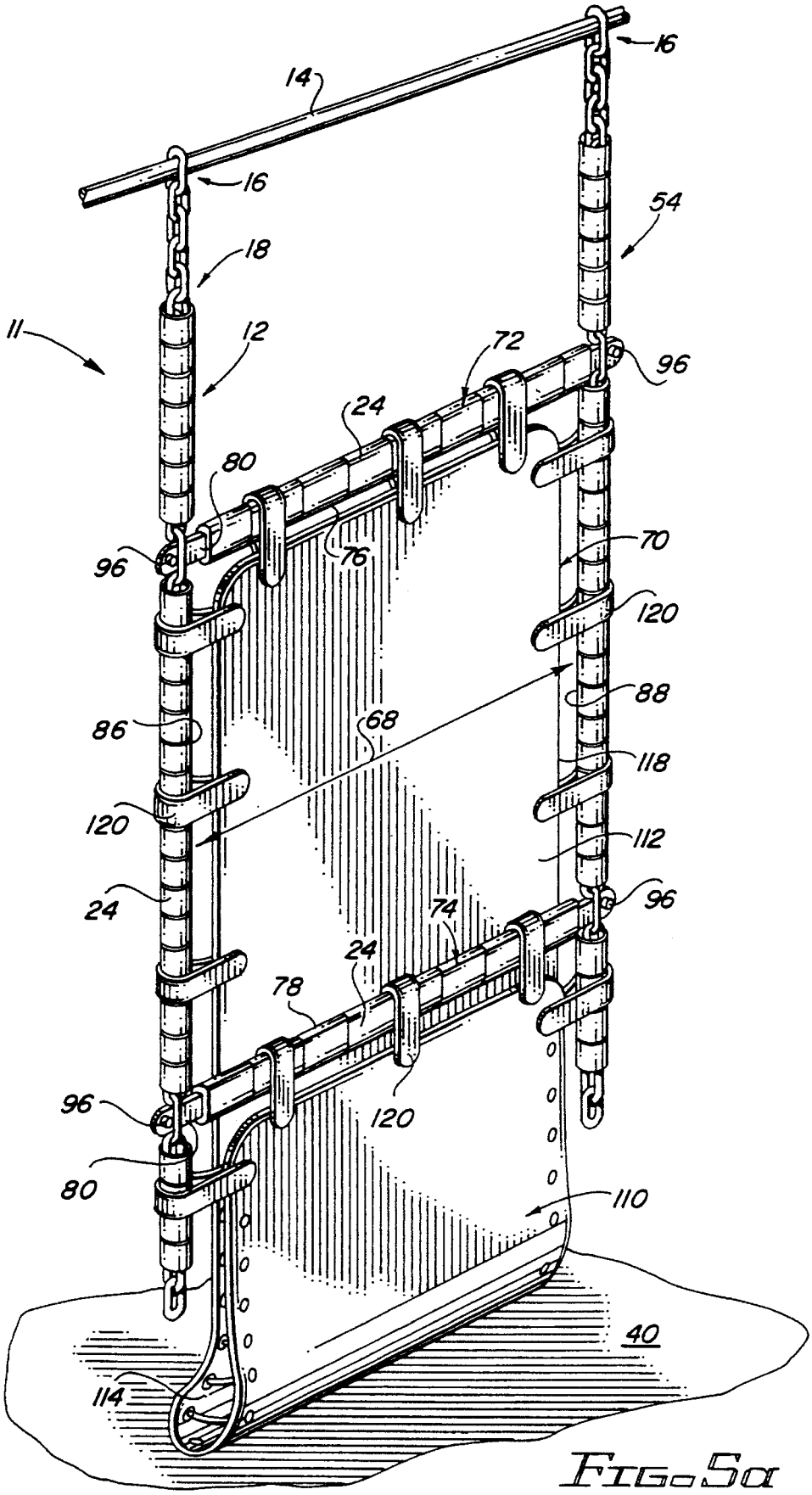
FIG. 5*a* is a left front perspective view of an alternate embodiment of a low rebound sports target of the present invention illustrating the use of a collection bag.
Figure 5D:
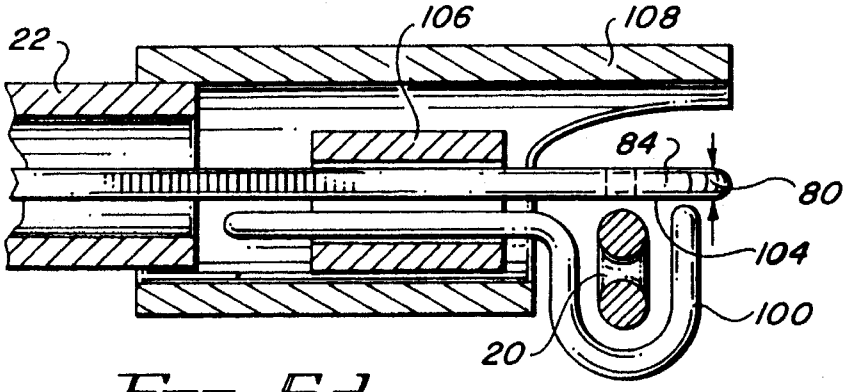
FIGS. 5*c* and 5*d* are partial perspective and cross-sectional views illustrating elements for affixing elements of the target.

In an alternate and currently preferred embodiment of the present invention, as illustrated with reference to FIG. 5*a*, the target 11 comprises the vertical resilient member 12 and generally equivalent second vertical member 54 freely suspended from the support 14 in a spaced relationship for defining a width dimension 68 of an aperture 70. A pair of horizontal members 72 and 74 in space relationship define an aperture top side 76 and an aperture bottom side 78 respectively.

Figure 5C:
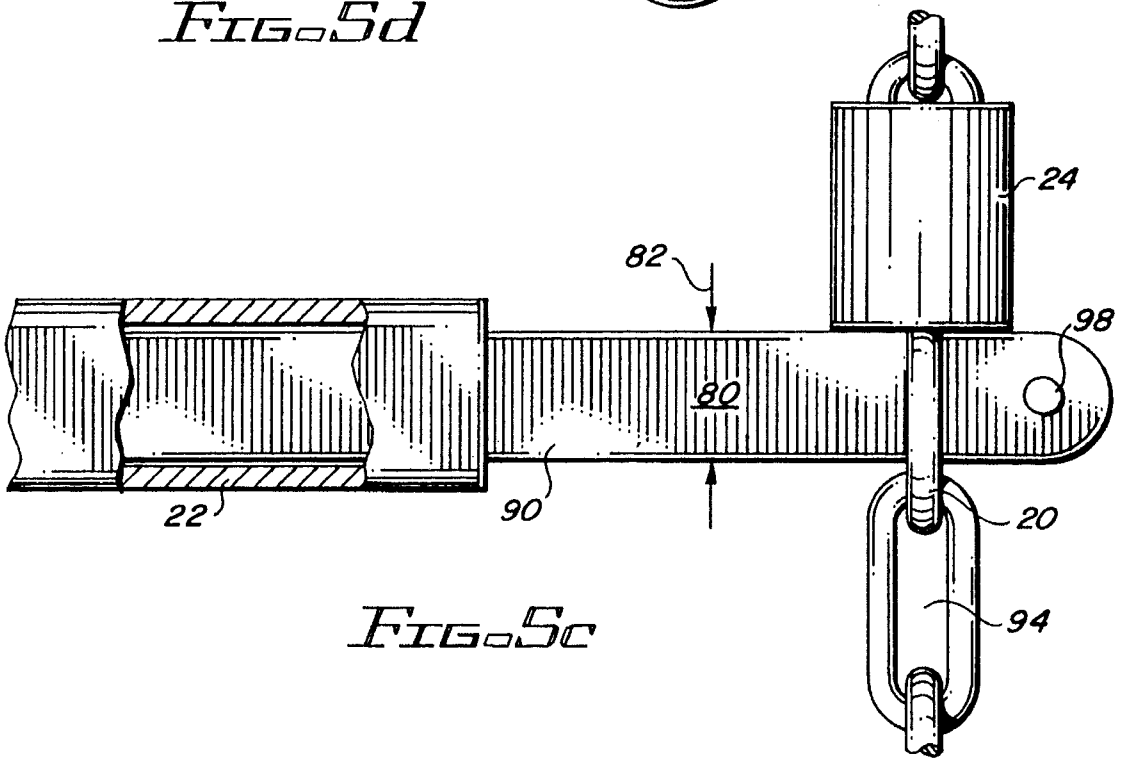

Although it is anticipated that various materials will be used for the horizontal members 72 and 74, as illustrated with reference to FIGS. 5*a* through 5*d*, the preferred structure of the target 11 comprises generally flat spring steel rods 80 for use as the horizontal members 72 and 74. With specific reference to FIG. 5*c*, the rod 80 has a vertical dimension 82 substantially greater than the depth dimension 84 as illustrated with reference to FIG. 5D. The vertical dimension 82 is such that the rod 80 will hold a fixed shape. By way of example, the aperture 70 described with reference to FIG. 5*c* represents a strike zone having generally straight aperture top side 76 and bottom 78 as well as generally straight left and right sides 86 and 88, respectively. Again with reference to FIG. 5*a*, the rods 80 are covered as is the chain 18 by tubing sections 24 like the chain link 20 described with reference to FIG. 2, the rod 80 is closely received by the tube bore 32 along its vertical dimension 82. The rod depth dimension 84 is sufficient to provide a flexible response to an object hitting the rod on the rod front face 90. Such rod flexibility in combination with the flexible tubing 22 and the rods free suspension by virtue of the rod 80 and chain 18 communication, a high speed baseball will have its energy absorbed to such an extent that the ball will safely rebound as earlier described.

Alternate materials are possible. For example, in an alternate embodiment of the sports target 11, a light weight aluminum tube was used in combination with the freely suspended chain. The aluminum tube was more rigid than the flat, strong steel rod used in the preferred embodiment. Such a combination provided adequate energy absorption of a high speed baseball hitting the tube. However, a heavier galvanized tube of similar diameter to the aluminum tube produced an unacceptable rebound.

In the preferred embodiment of the target 11, tube sections 24 are used along the rod 80. The rod 80 has its depth dimension 84 and vertical dimension 82 such that it is freely received through a link aperture 94 as illustrated with reference to FIG. 5C. By way of example, the rod end portion 92 is passed through the link aperture 94 sufficient to permit a nut and bolt assembly 96 to pass through a hole 98 through the rod 80 as further illustrated with reference to FIGS. 5*a* and 5*c*. In an alternate arrangement to the nut and bolt assembly 96, and with reference to FIG. 5D, a generally hook-shaped clip 100 made from generally flattened spring steel stock has a clip opening 102 in its hooking portion dimensioned to receive a chain link 20. The chain link 20 as illustrated with reference to FIG. 5*d* rests within the clip opening and the clip 100 is placed against the rod 80 in such a way that a rod surface 104 holds the chain link 20 within the clip opening 102. A clip tubing 106 holds the clip 100 against the rod surface 104. In the preferred embodiment of the target 11, using such a clip 100, a clip assembly cover 108 made from a flexible tubing covers the rod end portion 92, the chain link 20 contained within the clip opening 102 and the clip 100 wherein the clip assembly cover 108 receives any objects directed at that portion of the target 11.

Figure 5B:
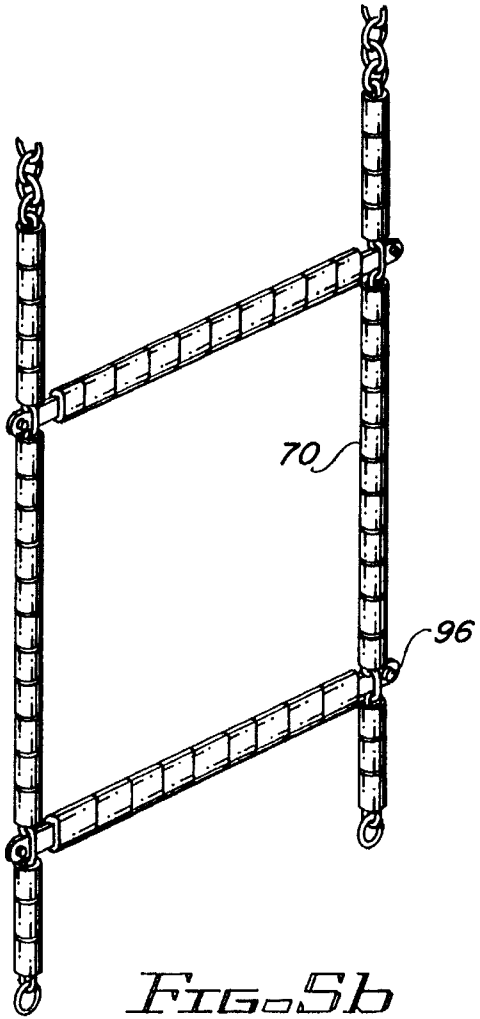
FIG. 5*b* is a left front perspective view of the target of FIG. 5*a* illustrating the formation of an aperture.

Thus far, the detailed description provided for the target 11 is as illustrated with reference to FIG. 5B wherein the aperture 70 is established. In the preferred embodiment of the target 11, a bag 110 having a bag opening 112 is affixed to the target 11 such that the bag opening 112 communicates with the aperture 70 such that the bag opening 112 will receive objects entering through the aperture 70. Such objects will be collected within the bag storage portion 114 generally below the aperture 70 and typically resting on the surface 40. The bag storage portion 114 is sufficient for storing a multiplicity of objects passing through the aperture. By way of example, the bag opening 112 is loosely affixed to the horizontal members 72 and 74 and to the vertical member portions 116 and 118 defining the left and right aperture sides 86 and 88 using straps 120 wrapped around the members for attaching the members to a perimeter portion 120 of the bag opening 112. It is anticipated that alternative affixing means will be used to affix the bag 110 to the aperture 70.

Figure 6D:
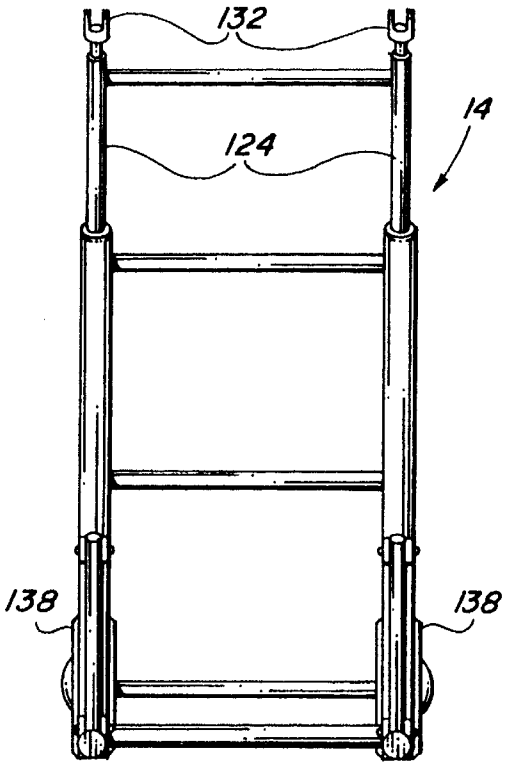
FIG. 6*d* is a front elevation view of the support of FIG. 6*c* illustrated in a closed position.
Figure 6B:
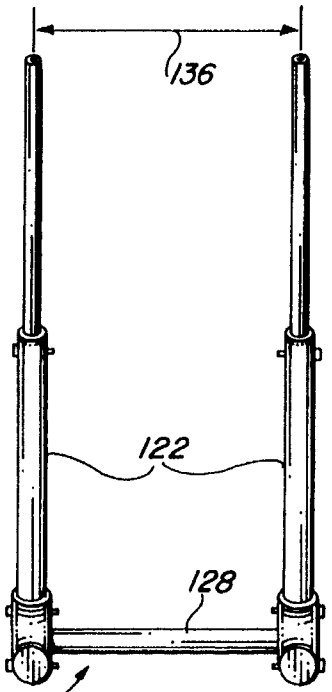
FIG. 6*b* is a front elevation view of the support of FIG. 6*a;*
Figure 7B:
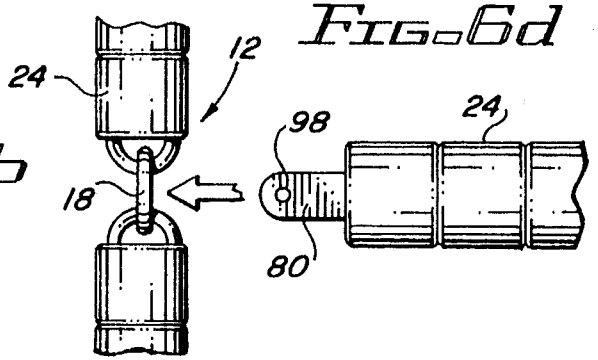
FIGS. 7*b* and 7*c* are partial front views of the target of FIG. 7*a* illustrating connection of vertical and horizontal elements.
Figure 6A:
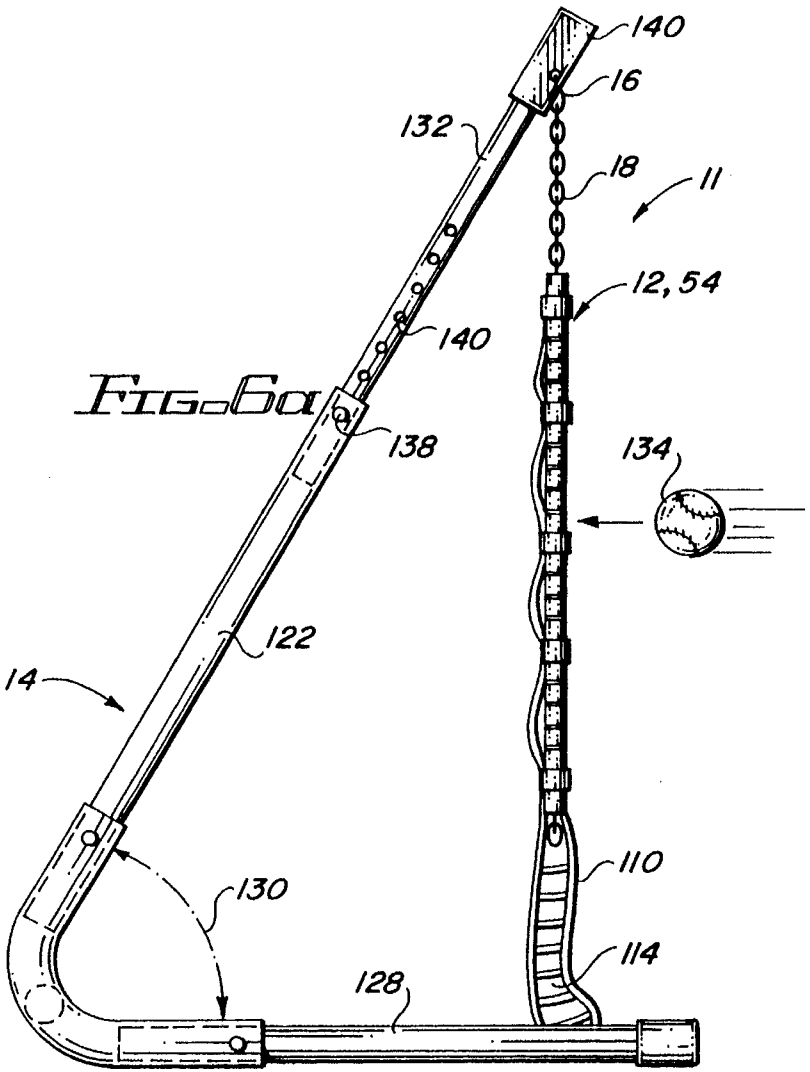
FIG. 6*a* is a side view of the target of FIG. 5A illustrating the embodiment of one support of the present invention and a front view of the support.

In one embodiment of the support 14 for the target 11, illustrated with reference to FIGS. 6*a* and 6*b*, support members 122 comprise telescoping concentric tubes 124 wherein the proximal ends 126 of the support members are affixed to a base 128 for affixing the support members 122 in a generally angled position with respect to the base 128. The support members 122 and the base 128 typically form an acute angle 130. The angle 130 is such that support member distal ends having the vertical members 12 and 54 affixed thereto support the vertical members in a generally spaced relation with the support members 122 wherein the vertical members 12 and 54 are positioned between a baseball 134 being delivered to the target 11 and the support members 122. In the preferred embodiment, the support members 122 are separated from each other by a width dimension 136 generally equal to the aperture width dimension 68 thereby placing the support members 122 within the shadow of the vertical members 12 and 54 for the oncoming baseball 134. With such an arrangement, the aperture 70 may be placed at any desired elevation by use of the telescoping concentric tubes 124 where pins 138 are passed through holes 140 within the tubes for affixing the tubes 124 at the predetermined position. Such support 114 provides a simple yet effective structure for suspending the vertical members 12 and 54 for positioning the aperture 70.

Figure 6C:
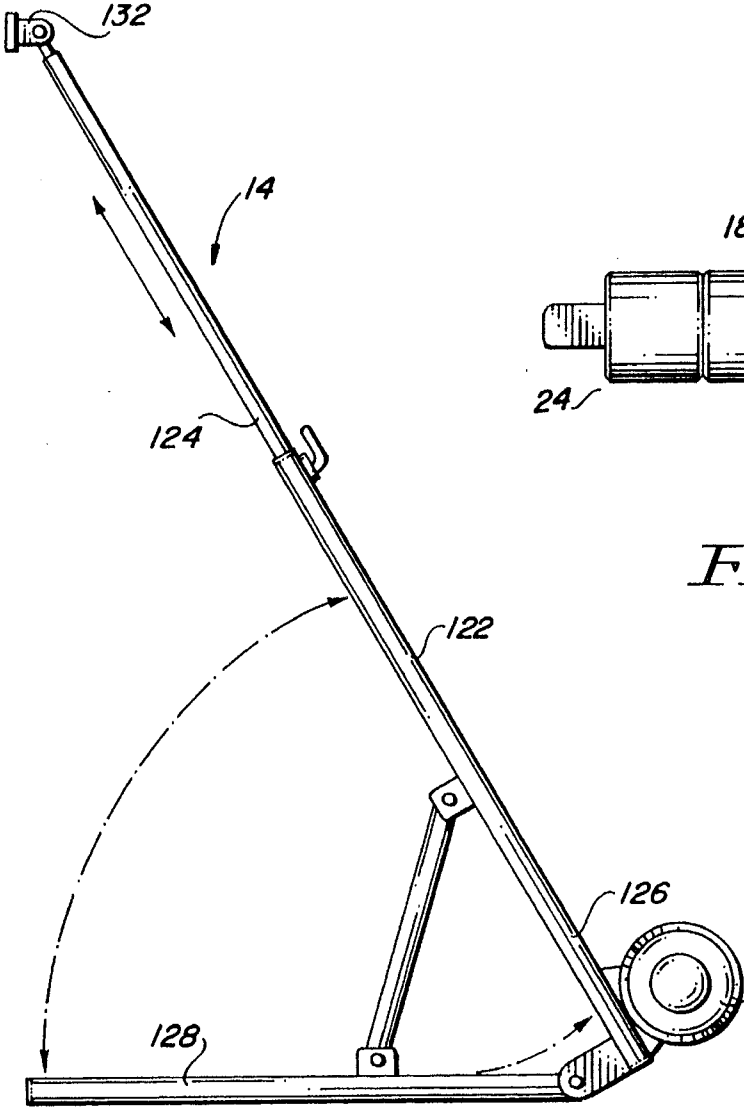
FIG. 6*c* is a side view of an alternate embodiment of a support for use with the present invention and a front view of the alternate support.

In an alternate embodiment for the support 14 and as illustrated with reference to FIGS. 6*c* and 6*d*, wheels 138 are attached to the support member proximal ends to aid in the convenience of relocating the target 11 or target 10 using such support 14. Further, the base 128 is hingedly affixed to the vertical member proximal ends for folding the base 128 against the support members 122 during storage or transport of the target 11. A further feature as illustrated again with reference to FIGS. 6*a* and 6*b* is the use of a cover shield 140 made from a soft rubber-like material placed over the support member distal ends 132 for shielding any exposed portion of the support 14 from an errant oncoming baseball 134.

Figure 7A:
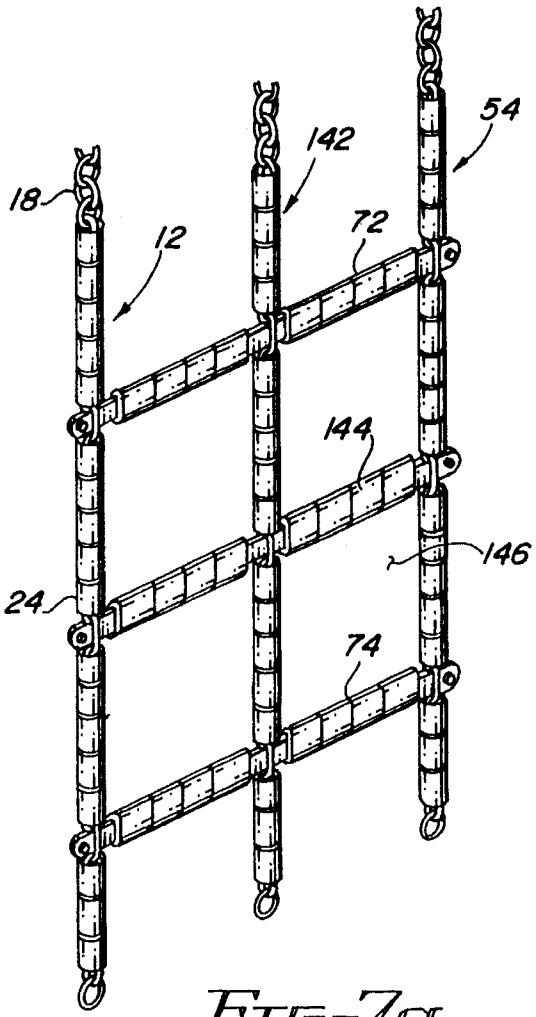
FIG. 7*a* is a partial left front perspective view of an embodiment of a low rebound sports target having multiple apertures.
Figure 7C:
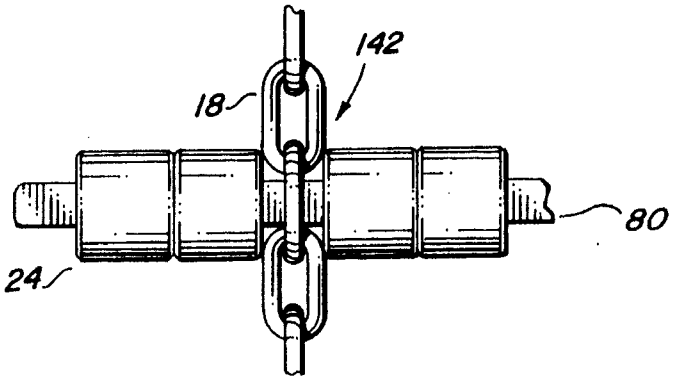

With such a structure for the target 11, alternate embodiments of the target 11 include the use of additional vertical members 142 generally equivalent to the vertical members 12 and 54 earlier described is freely suspended between the vertical members 12 and 54 and additional horizontal members 144 comparable to and placed between the horizontal members 72 and 74 provide aperture zones 146 for the aperture 70. Such zones 146, by way of example, are used to define various well known portions of a strike zone in the game of baseball. With the use of the tube sections 24 as earlier described for covering the chains 18 and rods 80, such aperture zones 146 are easily configured with the structure as described and as further illustrated with reference to FIGS. 7*a* and 7*c*. The tube sections 24 can be slid along the chain to expose a chain link 18 and slid along the rod 80 for passing the rod through the link aperture 94. Once positioned in a predetermined arrangement, the tube sections 24 are positioned to provide a shroud for the rods 80 and chains 18 as earlier described.

Figure 8A:
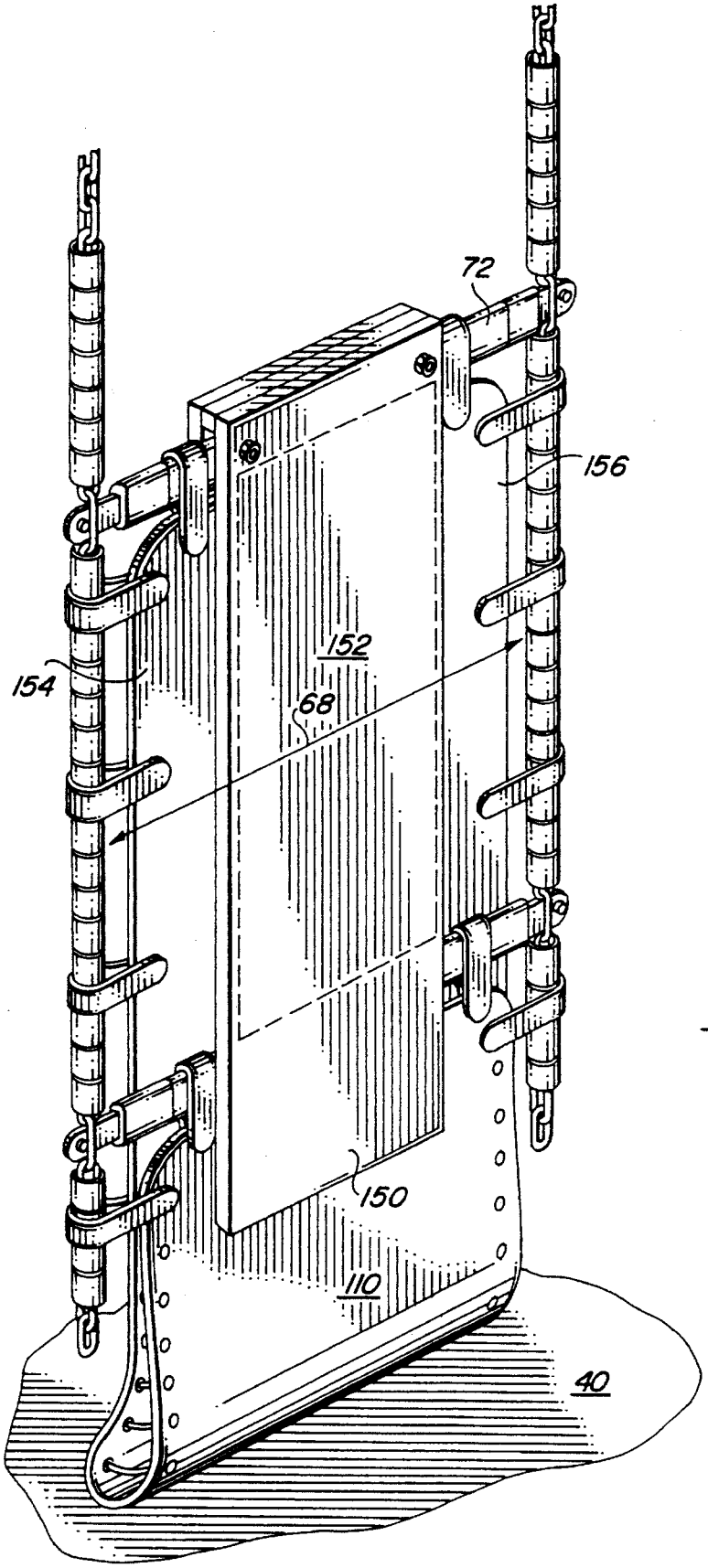
FIG. 8*a* is a left front perspective view of the target of FIG. 5*a* in an alternate use of the present invention.
Figure 8B:
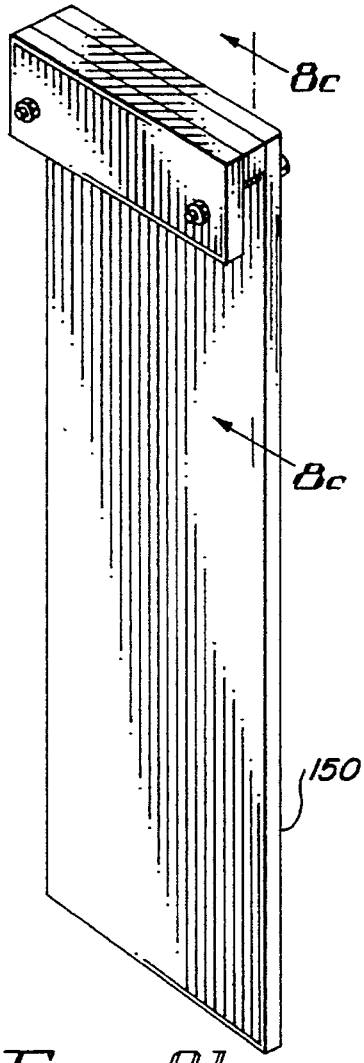
FIG. 8*b* is a left rear perspective view of the sheet of FIG. 8*a;*
Figure 8C:
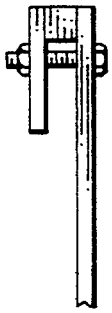
FIG. 8*c* is a partial side view of the sheet of FIG. 8*b;*
Figure 9A:
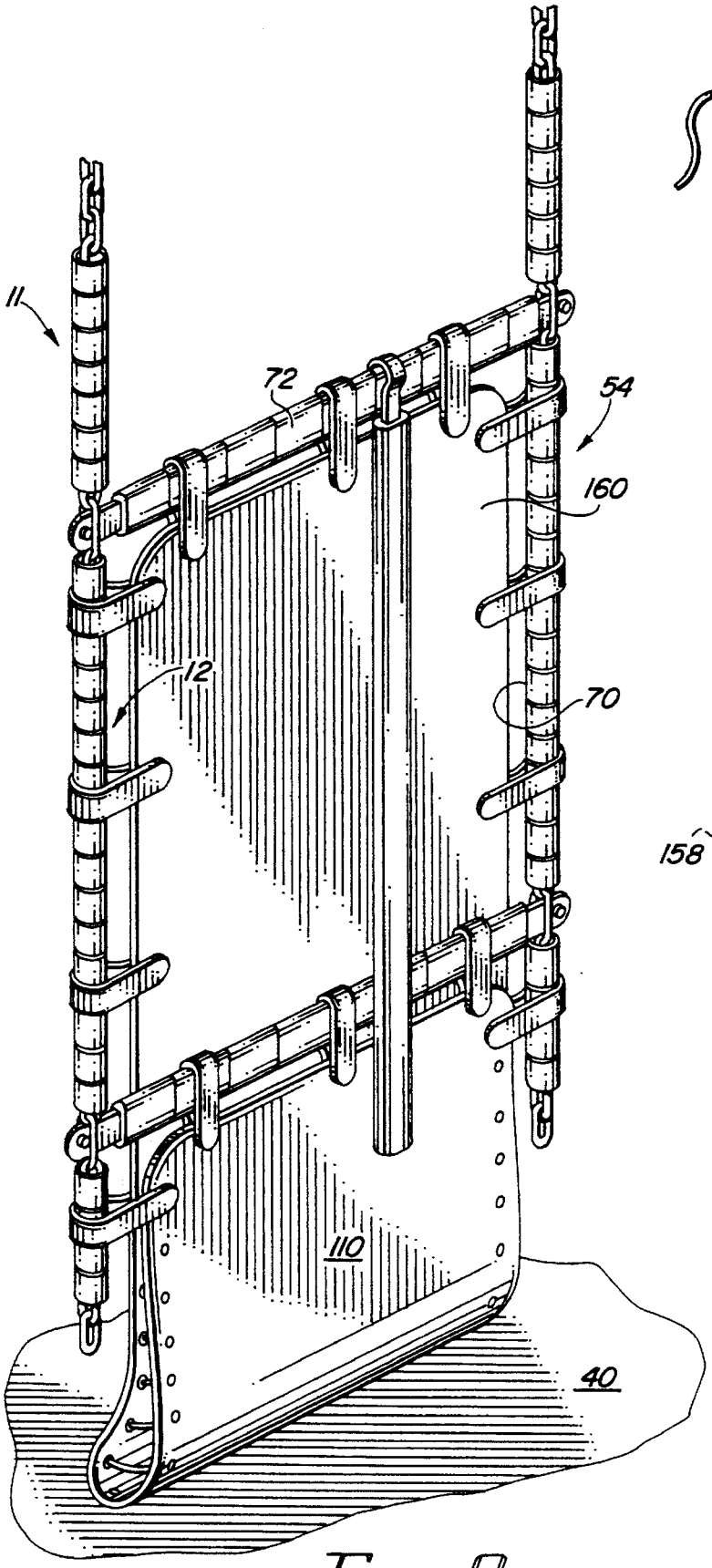
FIG. 9*a* is a left front perspective view of the target of FIG. 5*a* in yet another use of the present invention.
Figure 9B:
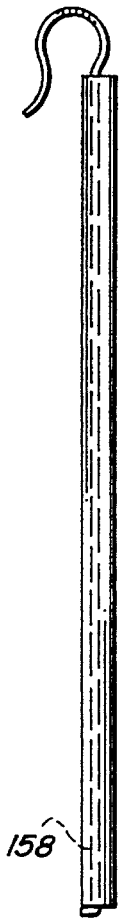
FIG. 9*b* is a left elevation view of the resilient rod of FIG. 9*a;*
Figure 9C:
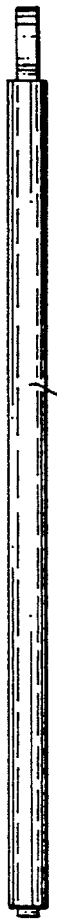
FIG. 9*c* is a front elevation view of the rod of FIG. 9*b;*

With reference to Figures, additional elements are used in combination with the target 11 for defining alternate aperture zones 148. By way of example, and with specific reference to FIG. 8, a resilient rubber sheet 150 having a width dimension 152 generally smaller than the aperture width dimension 68 is suspended over the aperture 70 where the sheet 150 provides a blocked aperture portion 152 and open aperture portions 154 and 156. By slidably affixing the sheet 150 to the horizontal member 72 and by providing various width dimensions 152 for the sheet 150, various size open aperture portions 154 and 156 can be presented to the player using the target 11 in this configuration. By using an elongated resilient rod in place of the rubber sheet 150, an alternate image of the aperture 70 is presented to the player. In particular with reference to FIGS. 9*a* through 9*c*, the elongated resilient rod 158 is slidably affixed to the horizontal member 72 for dividing the aperture 70 into aperture sections 160. In this embodiment, the elongated resilient rod 158 is covered by tubing 162 made from material similar to the tubing 22 and tubing section 24 earlier described. With such an arrangement, varying practice skills can be completed by the player.

Figure 10A:
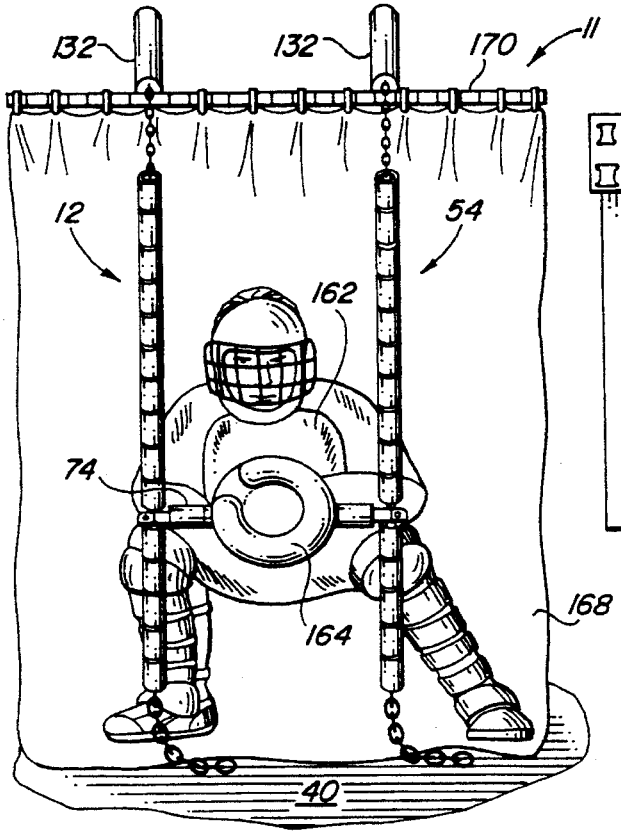
FIG. 10*a* is a front perspective view of an alternate use of the present invention including a backdrop screen member.
Figure 10B:
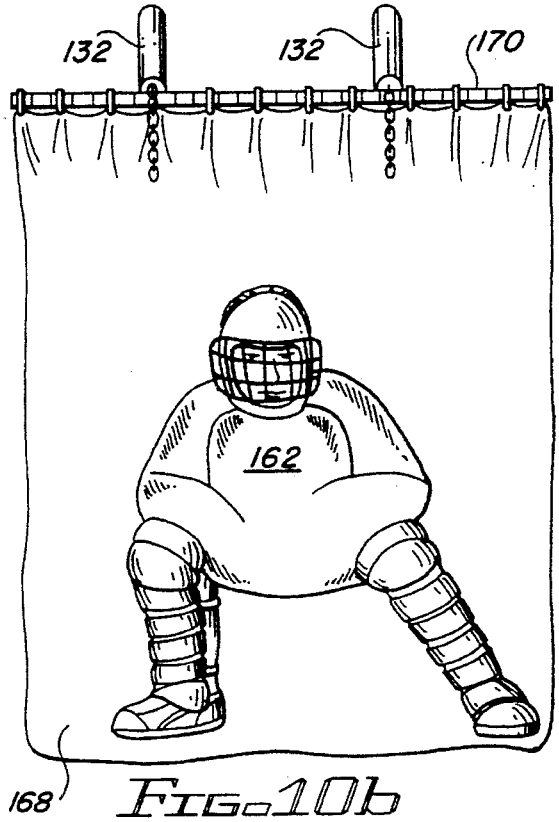
FIG. 10*b* is a front perspective view of the screen member of FIG. 10*a;*

The target 11 is also used in combination with a target image 162 placed behind the vertical members 12 and 54 between the vertical members 12 and 54 and the support members 122 described earlier with reference to FIG. 6*a*. With reference to FIGS. 10*a* and 10*b*, the target image 162 comprises the image of a baseball player positioned to receive a baseball thrown at the target 11 in an attempt to hit the player's glove 164 affixed to a the portion of the horizontal member 72 or the vertical members as earlier described with reference to FIGS. 4*a* and 4*c*. The target image 162 of the player is affixed to a surface 166 of a screen member 168. In one embodiment, the screen member 168 is made from a canvas material and is suspended from a horizontal support member 170 freely suspended from the support member distal end 132. With such a combination of screen member 168 and target 11, a more accurate simulation of playing conditions is presented for the player. Further, the low rebound features of the target 11 as described and the continuing low rebound nature of a freely suspended canvas in the form of the screen member 168 continue to provide safely rebounding baseballs.

With particular reference to the game of baseball, the width of home plate is typically seventeen inches. During a pitch, if any portion of a baseball typically having a circumference between nine and nine and one quarter inches passes over an edge of homeplate, such a baseball thrown the player is defined as a strike. With the structure describing the target 11, it has been determined an appropriate separation between the vertical members 12 and 54 is twenty-one and a half inches from center line to center line of the members. Further, the diameter of the tubing 32 or tubing sections 24 is one inch. In the preferred embodiment, long link chain having a width of three quarter inches is used permitting easy attachment of the rods 80 into the chain apertures 94 as earlier described. Again with reference to FIG. 2, such a combination of dimensions permit a baseball 134 having its center 172 traveling along a path 174 tangent to the tube section 124 will make contact with the tube section at a position 176 in such a way to change the path 172 to a new path 178 falling within the aperture 70 for defining a strike. With such an arrangement, the baseball 134 hitting the target elements defining the aperture 70 will produce a strike and at the same time provide visual feedback to the player from the movement of these elements. In contrast, when one considers the diameter of a baseball to be approximately two and three quarter inches and again the width of homeplate at seventeen inches, it would be natural to think that the separation between the inner edges of an aperture should be twenty-two and a half inches (2.75"+2.75"+17"). With the structure as defined for the target 11, and the desire to have visual feedback from the target to the player in response to the baseball thrown at the target 11, the geometry as described is most appropriate.

II. Summary Description of Referenced Application

Figure 11B:
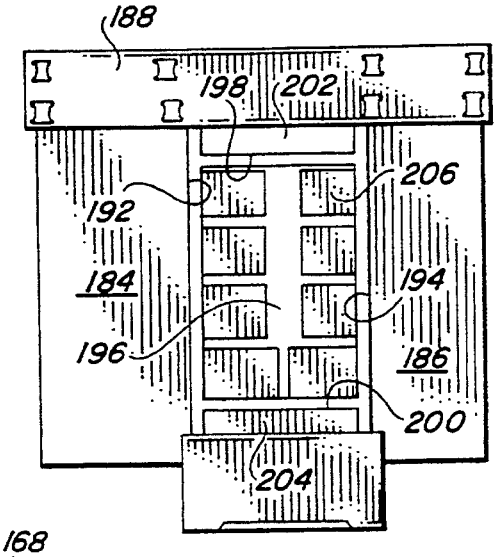
FIG. 11*b* is an alternate embodiment of the sports target of FIG. 11*a;*
Figure 11D:
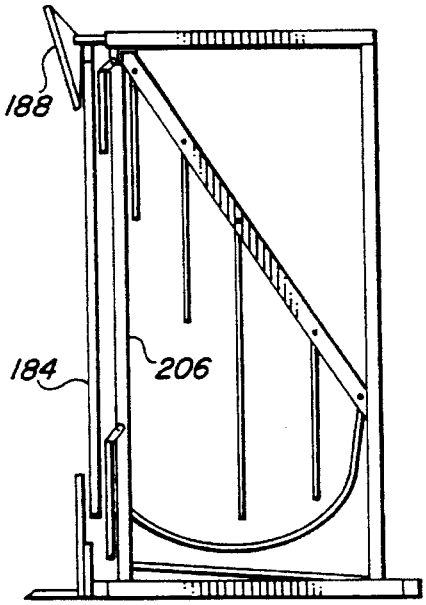
FIG. 11*d* is a side view of the sports target of FIG. 11*b;*
Figure 11C:
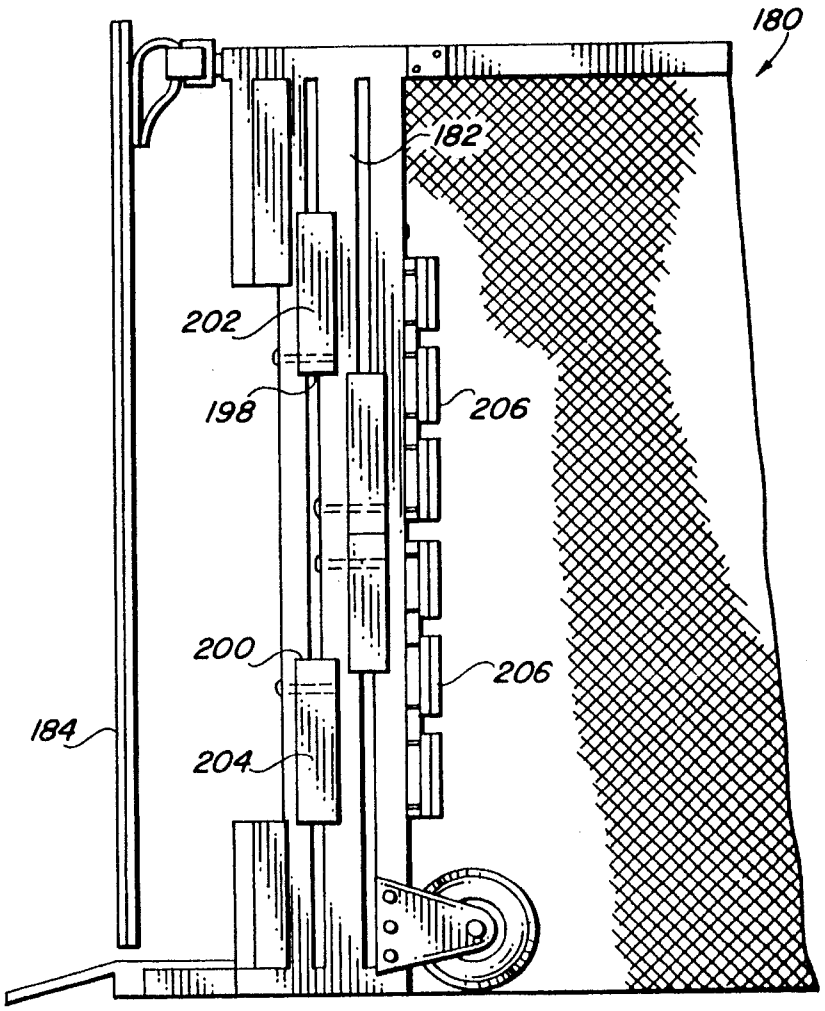
FIG. 11*c* is a side view of the sports target of FIG. 11*a;*
Figure 11A:
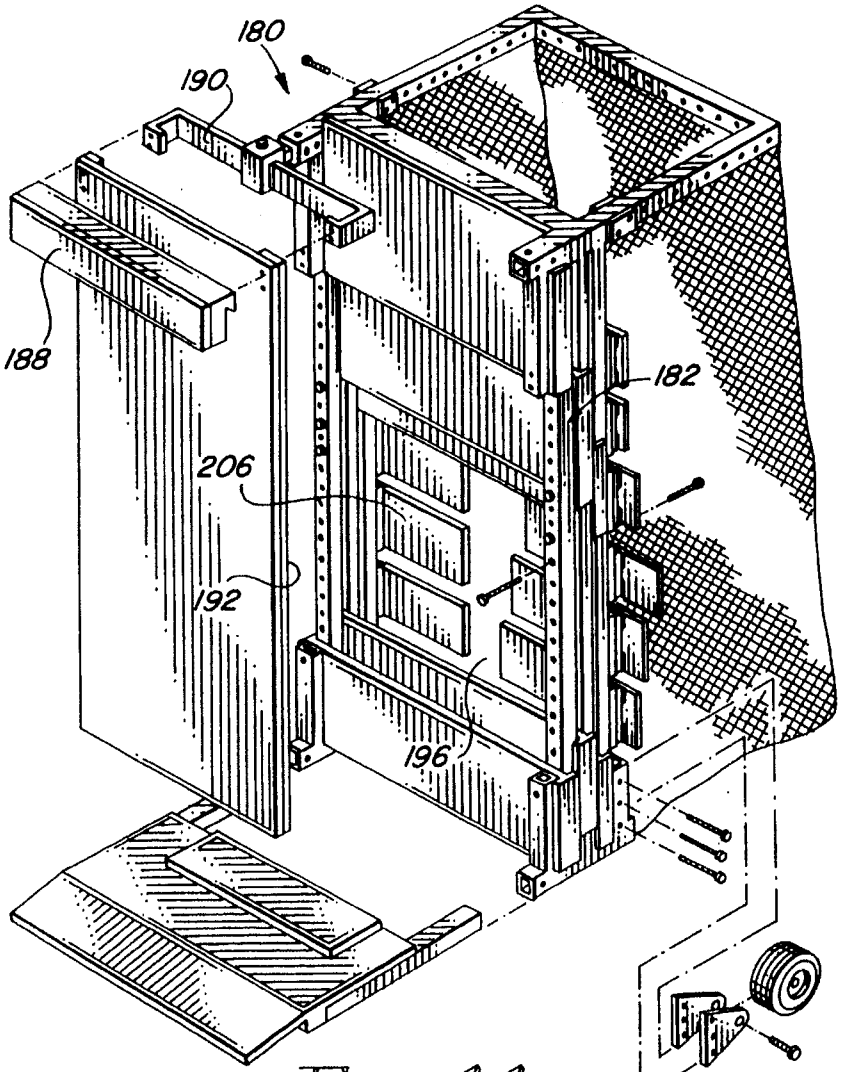
FIG. 11*a* is a partial exploded perspective view of the sports target of the referenced application.

With reference to FIGS. 11*a* through 11*c* the preferred embodiment of the sports training target 180 comprises a frame 182 from which a first shutter 184 and a second shutter 186 are suspended and held away from the frame 182. Shock absorbent fascia members are affixed to the shutters 184 and 186 forward of racks 190 holding the shutters to the frame so as to provide added imagery absorbent capability at the structural connection between the shutters 184 and 186 and frame 182 as illustrated in FIG. 11A for the preferred embodiment of the sports target 180 and alternate embodiment illustrated in FIG. 11*d*. A first shutter edge 192 and a second shutter edge 194 define left and right sides of an aperture 196. An upper shutter edge 198 and a lower shutter edge 200 of an upper shutter 202 and lower shutter 204 respectively define upper and lower portions of the aperture 196 as illustrated with further reference to FIG. 11*b*. In one embodiment multiple upper and lower shutters are combined to provide adjustment of the aperture vertical dimension. Target elements 206 are hingedly affixed to the frame 182 and extend into the aperture 196. As described earlier in the specification, such a combination of elements constitutes exclusion areas rather than a border defining a target zone as presented in the present invention. A border rather than an exclusion area as presented by the vertical and horizontal members of the present invention provide the player with a finer and more flexible delineation of target areas while at the same time providing a target that is less complex, less expensive to construct and simple to operate which as earlier stated is one object of the present invention.

Figure 12:
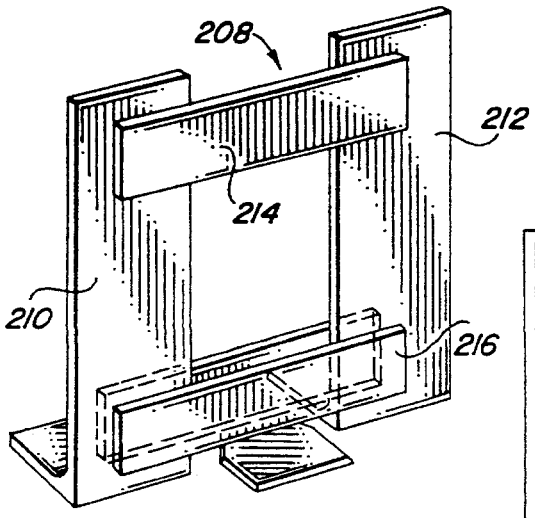
FIG. 12 is a left front perspective view of an alternate embodiment of the sports target of the referenced application.

As presented in the referenced application, using thick rubber sheets and forming them to fit together with each other provides an effective alternate embodiment for a frameless target 208 as illustrated in FIG. 12. By using thicker rubber sheets for left and right vertical shutters 210 and 212 and upper and lower shutters 214 and 216 where there edges form an aperture 218 the frameless target 208 provides an improvement over the sports target by having fewer elements and as a result providing a simpler target for portable use. The present invention has taken the teachings of the sports target 180 wherein target elements such as the shutter 184 are suspended in a direction toward the player in a generally spaced relationship with the frame 182 and the need to provide a target having fewer elements as the frameless target 208 for a portable use.

Figure 13:
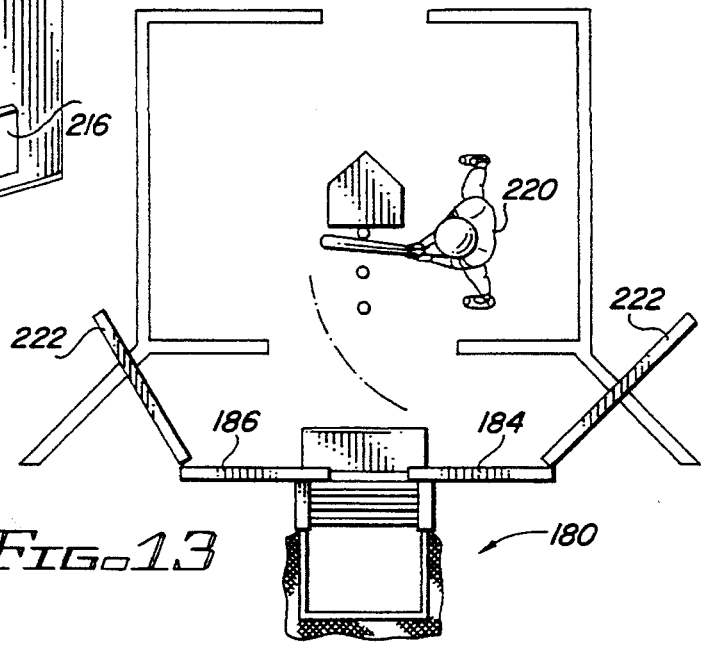
FIG. 13 is a top view of the sports target of FIG. 11*a* illustrating a use.
Figure 14A:
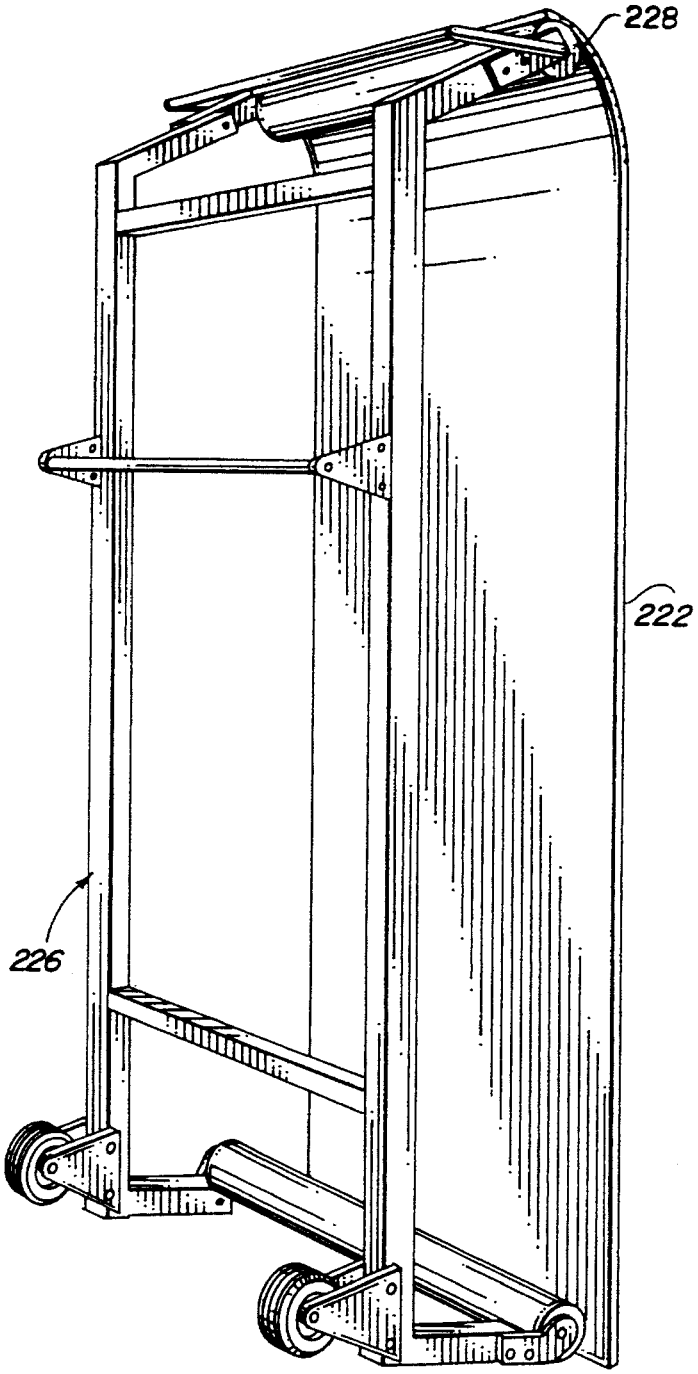
FIGS. 14*a* and 14*b* are right rear perspective view and front view of a screen frame and screen used in combination with the target of FIG. 11*a;*
Figure 14B:
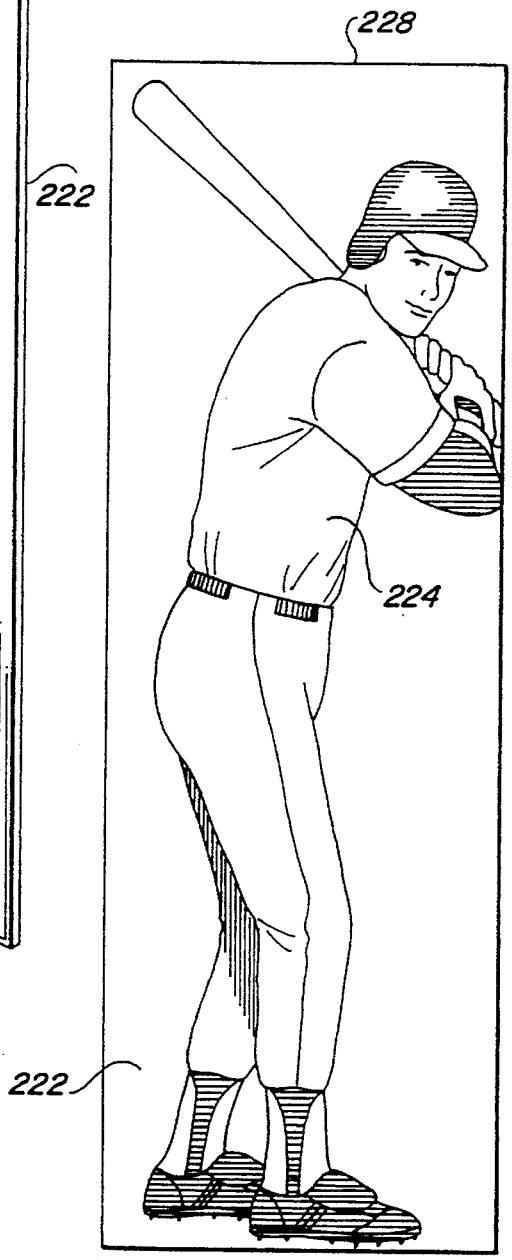
Figure 15C:
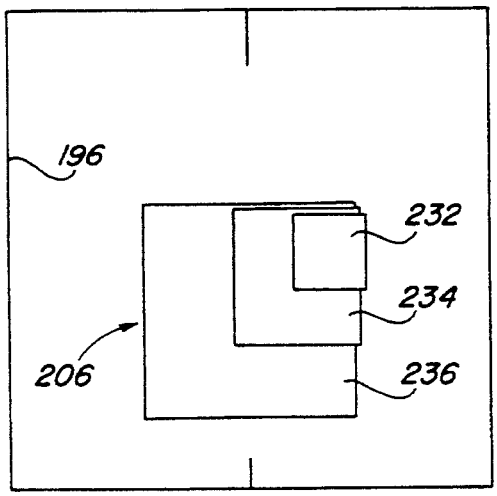
FIGS. 15*c* and 15*d* are partial front views of target elements illustrating alternate configurations for use in variable range pitching drills.
Figure 15D:
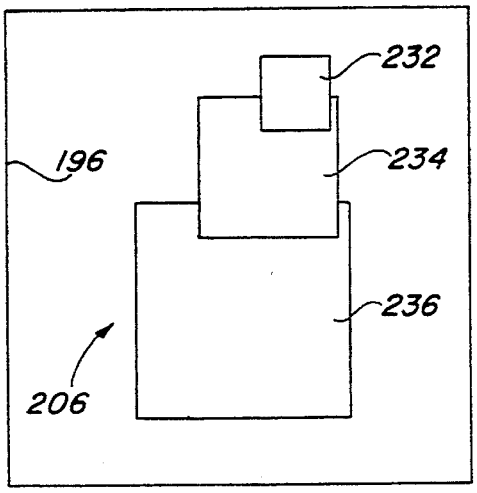
Figure 15A:
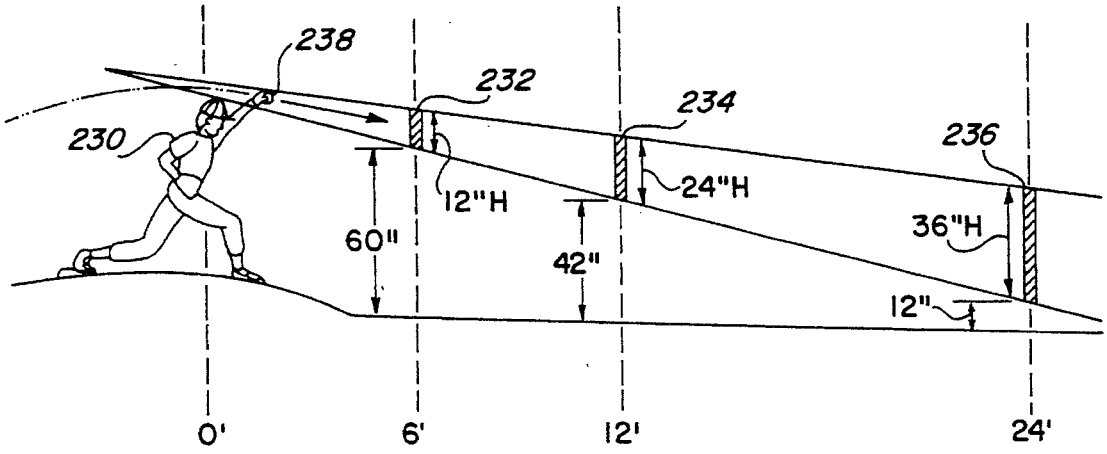
FIGS. 15*a* and 15*b* are elevational and top views illustrating a relationship between a player and target elements.
Figure 15B:
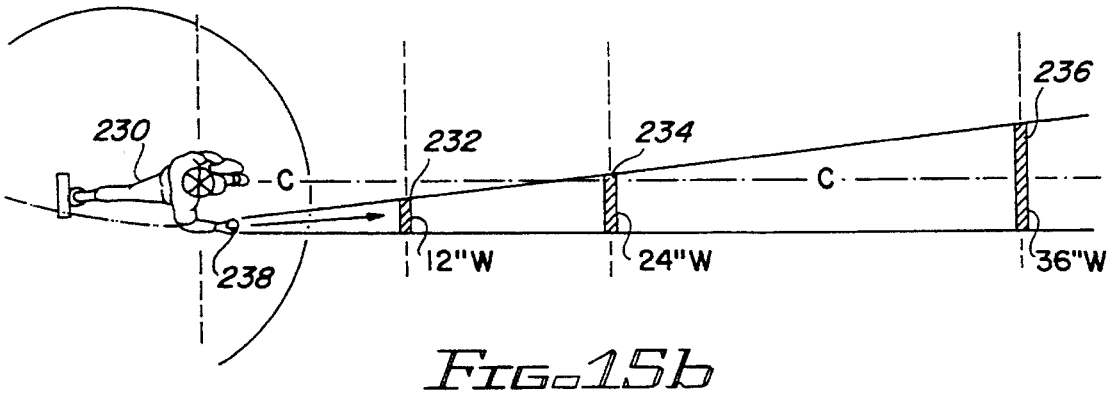

As further described in the reference application, there is a need for close range batting and pitching configurations. The use of low rebound surfaces as presented in the original application permits the targets 180 and 208 to be used in such close range configurations as illustrated by way of example with reference to FIG. 13. By way of this example, a batter 220 hits from a stationary tee or soft toss device (not shown) into the target 180. The target shutters 184, 186, 202 and 206 are combined with screens 222 positioned on each side of the target 180 for achieving specific hitting drills and developing specific batting skills. In this manner, visual game simulations in combination with aperture targeting for greater realism and performance can be achieved. With reference to FIG. 14*a* and 14*b*, the screens 222 will have various images 224 such as a batter. The screen 222 is then placed proximate the aperture 196 for providing a more realistic view of a pitching situation for a pitcher practicing his skills. Consistent with the development of the invention in the original application, the screen 222 is suspended away from the screen frame 226 at a top end 228 to suspend the screen in a direction toward the player and as earlier described in a generally spaced relation with the screen frame 226.

With reference to FIGS. 15*a* through 15*d*, variable range pitching drills were described in the original application. The target elements 206 were sized to accommodate the distance from the target 180 and located within the aperture 196 to further accommodate a parallax effect for a pitcher 230 when closer to the target element 206 then in the case of an actual game condition. As described in the original application, target elements 232, 234, and 236 as illustrated with reference to FIGS. 15*a* through 15*d*, were proportionally sized for specific distance from the aperture 196. By way of example, six foot, twelve foot and twenty-four foot distances were illustrated as further illustrated in FIGS. 15 and 15B. The pitcher 230 would throw to the appropriate target element 232, 234 or 236 that corresponded to his distance six, twelve or twenty-four feet from the target element. Further as illustrated again with reference to FIGS. 15*c* and 15*d*, the elements 232, 234 and 236 would be horizontally and vertically adjusted within the aperture 196 to compensate for the various pitching styles, for example a three quarter overhand pitcher as illustrated in FIG. 15D and a side arm pitcher as illustrated in FIG. 15*c*. The positioning of the target elements 232, 234 and 236 was therefore based on the distance from the target elements and the horizontal and vertical position of the ball release point 238 of the pitcher 230. The target elements further were proportional to a full scale target such as a strike zone at a full scale distance and aligned within the limits formed by the original release point 238 of the pitcher 230 and the borders of the original strike zone. The target 11 of the present invention as described with reference to FIG. 5A and the alternate embodiment presenting multiple apertures 146 as described with reference to FIGS. 7*a*, 8*a* through 9*c* clearly provide the capability for varying aperture sizes to account for variable range pitching drills and further providing safe conditions for such drills, a primary object of the present invention.

III. Operation of Present Invention

Figure 16A:
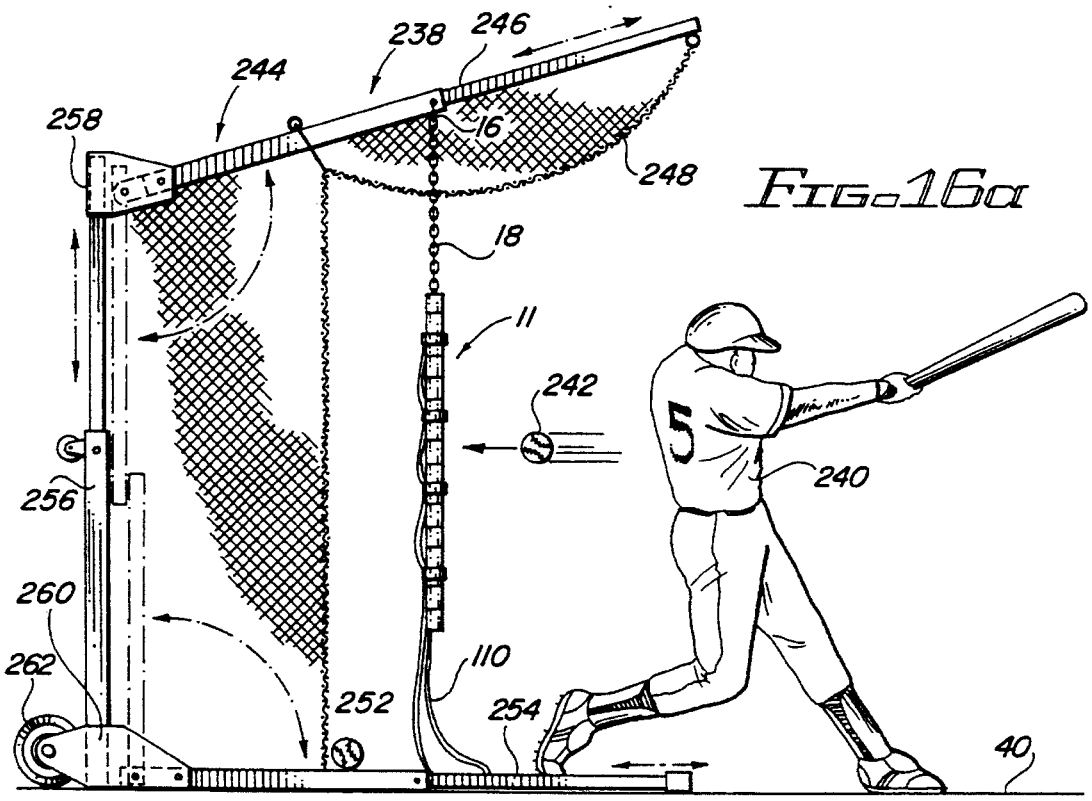
FIG. 16A is a partial side elevational view of a target assembly illustrating a use of the low rebound sports target of FIG. 5*a;*

It is anticipated that the target 10 and target 11 will be used in various configuration to provide support for various practice skills such as pitching, batting, fielding and others well known to the sport of baseball and similar sports. With reference to FIG. 16*a*, one use of the target 11 is illustrated in a target assembly 238 comprising the target 11 freely suspended to place its aperture appropriately behind a batter 240 swinging at a baseball 242 thrown at the target 11. The chain 18 of the target 11 is connected at its top ends 16 to the support 244 along a support arm 246 dimensioned and positioned to suspend the target 11 in its appropriate position for this particular skill herein described. Further, netting 248 is suspended from an arm distal end 250 so as to pass over the target aperture portion and behind the target 11 for receiving baseballs traveling past the target 11 for collection against the netting 252. Baseballs 242 passing through the target aperture will be collected in the target bag 110 as earlier described. Baseballs rebounding or passing outside of the target aperture will then be collected by the netting 248 coming to rest behind the target 11.

Figure 16B:
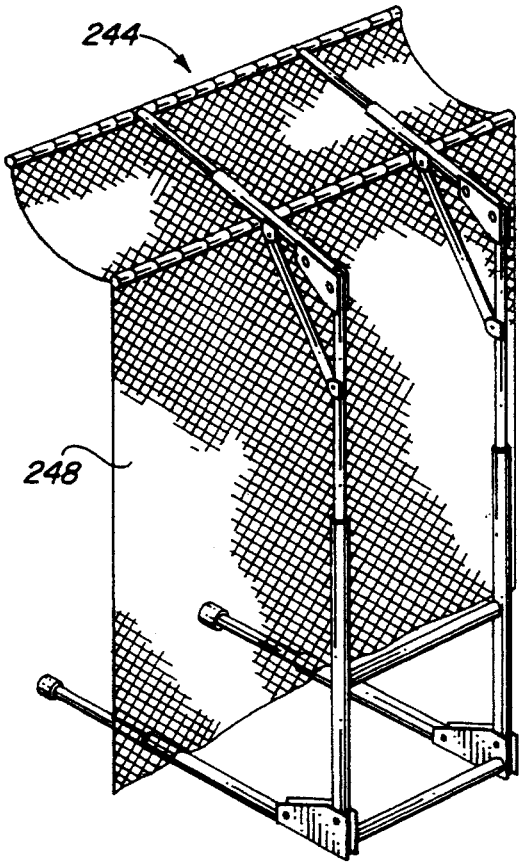
FIG. 16*b* is a left rear perspective view of the target assembly of FIG. 16*a;*
Figure 16C:
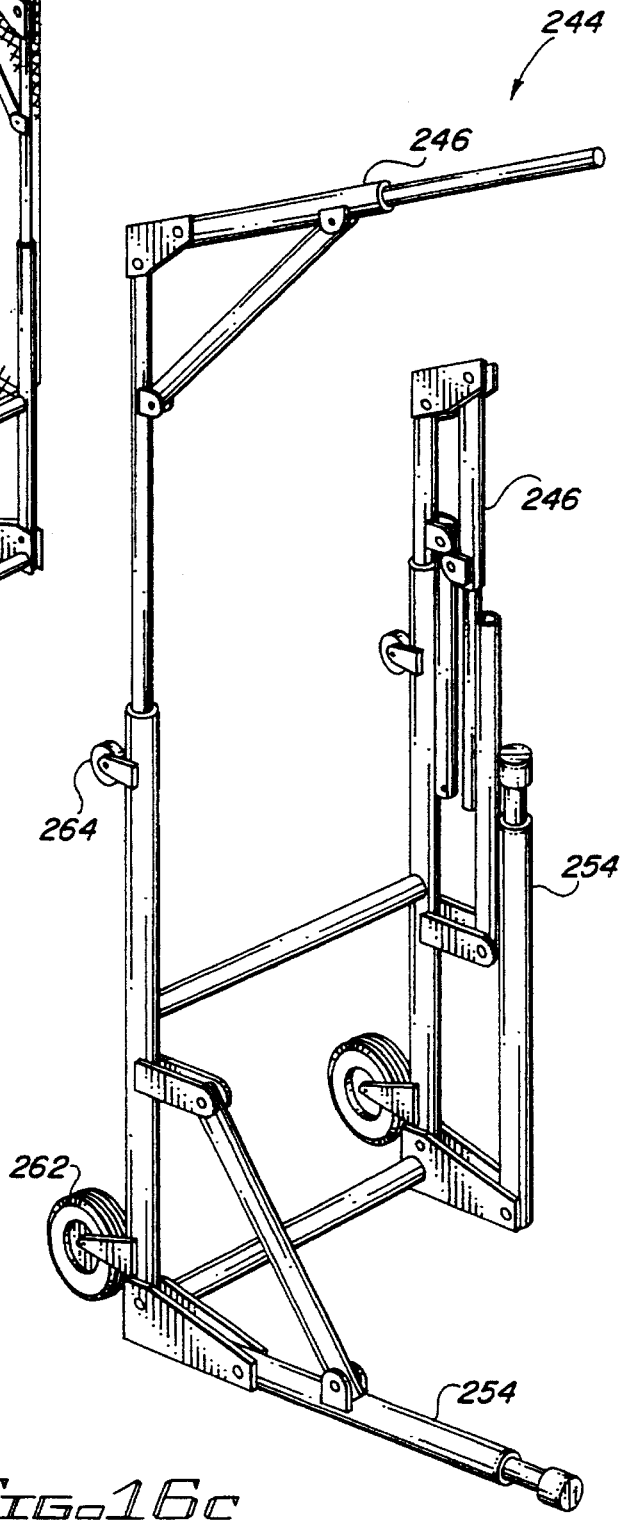
FIG. 16*c* is a left perspective view of the embodiment of the support of FIG. 16*a;*

With reference to FIGS. 16*a* and 16*c*, the support 244 is an alternate embodiment of the supports earlier described for positioning the targets 10 and 11 and comprises parallel base arm members 254 for resting on the ground. A pair of vertical arm members 256 extends from the base members 254 for positioning the support arm 246 appropriately above the batter for suspending the target 11 and netting 248 as earlier presented. The support arms 246 and base arm members 254 are hingably affixed to the vertical arm members 256 at distal 258 and proximal 260 ends, respectively. Each of the support arms 246 base arm members 254 and vertical arm members 256 in the preferred embodiment are formed from telescoping concentric tubing to provide adjustment of the elements and compaction when folding the elements within each other for added portability and convenience in storage. As described with reference to earlier supports, wheels 262 are rotatably affixed to the vertical arm member proximal end 260. With such a combination of features, compactness and folding of the support 244 is easily accomplished as illustrated with reference to FIG. 16*c*. Depending on the overall size of the support 244 and the needs provided by the particular practicing skills, features as earlier described or as well known in the art may be added such as additional wheels 264 for relocating the support 244 or entire target assembly 238.

Figure 17:
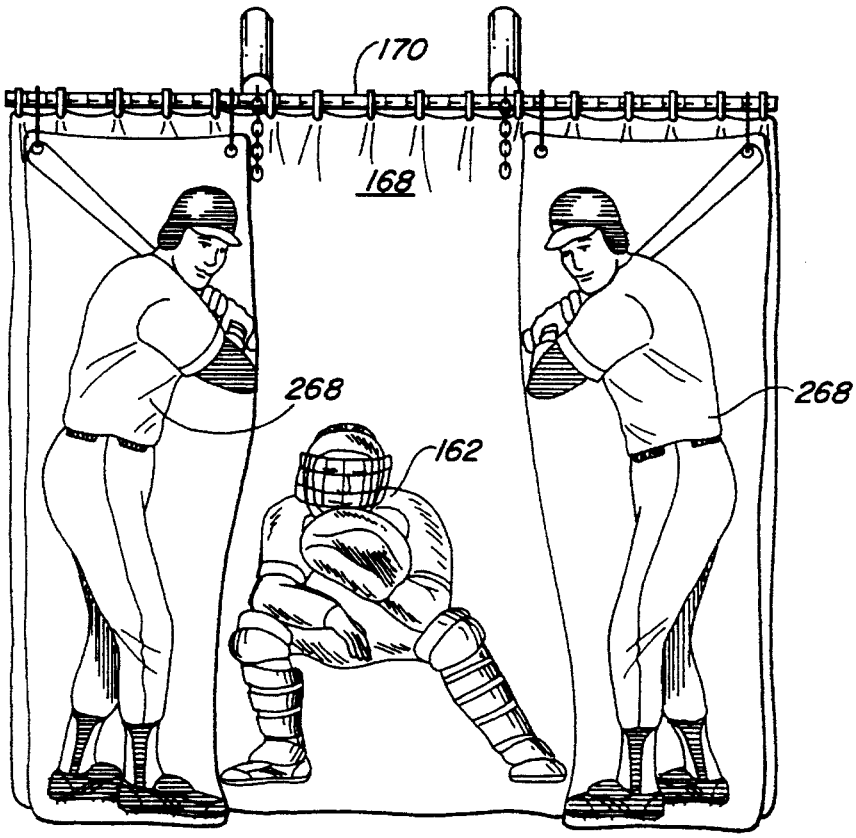
FIG. 17 is a front perspective view of a screen combination used with the targets of the present embodiment.
Figure 18:
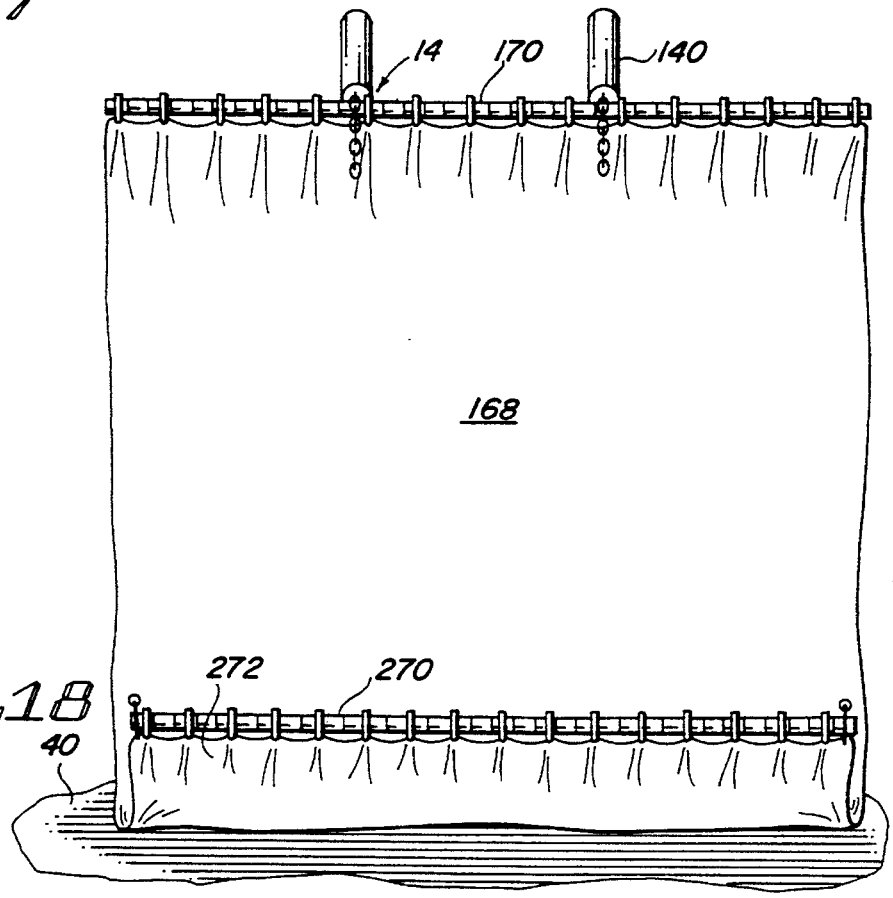
FIG. 18 is a front perspective view of an alternate embodiment of the screen of FIG. 17.

Further, with reference to FIG. 17, it is anticipated that the images herein described and additional images will be used in combination to create as realistic an effect for the player as possible in practicing and developing his skills. With specific reference to FIGS. 17, the screen member 168 earlier described with reference to FIGS. 10A and 10B is used in combination with second screen members 266 having alternate images 268 configured for the skill being developed. By way of example as herein illustrated, the second screen members 266 are freely suspended from the horizontal support member 170 which in turn is supported by the support 14 for alternate supports as herein described. As a further improvement to the screen member 168 and as illustrated with reference to FIG. 18, a lower horizontal support member 270 is suspended from the horizontal support member 170 and positioned above but proximate the surface 40. The screen member 168 is configured to have an overall length for providing a portion of the screen member to drape onto the surface 140 for forming a bag-styled collection area 272 much the same way as described with reference to FIG. 5*a* for the bag 110 having the bag storage portion 114.

As thus presented, the target 10, the target 11 and their various combination of uses provides a wide variety of practice environments needed and useful for safely developing the sports skills well known to the art. In addition, with the embodiments of the targets fully described, alternate embodiments, and target component embodiments shown, it is anticipated that one skilled in the art of sports training can device yet other embodiments and combination of elements disclosed useful in developing the appropriate sports skills.

Having now described the invention, the construction, the operation and use of preferred embodiments thereof, and the advantageous new and useful results obtained thereby, the new and useful constructions and reasonable mechanical equivalence thereof obvious to those skilled in the art are set forth in the appended claims.

While a specific embodiments of the invention have been described in detail herein above, it is to be understood that various modifications may be made from the specific details described herein without departing from the spirit and scope of the invention as set forth in the appended claims.

Having now described the invention, the construction, the operation and use of preferred embodiments thereof, and the advantageous new and useful results obtained thereby, the new and useful constructions, methods of use and reasonable mechanical equivalents thereof obvious to those skilled in the art, are set forth in the appended claims.

What is claimed is:

1. A sports target comprising:

a support;

an elongated vertical member having a top end hingedly affixed to the support for freely suspending the member from the support, the vertical member uniformly resilient for receiving an object delivered to the member by a player, and in combination with the free suspension of the member, absorbing energy of the object for sufficiently limiting rebounding of the object from the member to a safe position for the player; and flexible tubing having a bore dimensioned to receive the member, the tubing covering the member along a substantial portion of the member, the tubing sufficiently flexible for receiving the object a multiplicity of times for providing effective reuse of the object by the player, the tubing providing a visual feedback response to the player after receiving the object.

2. The target as recited in claim 1, wherein the vertical member comprises chain formed from a multiplicity of links.

3. The target as recited in claim 2, wherein the tubing further comprises a multiplicity of tubing sections communicating with each other, each section having a tube wall defining the bore dimensioned to closely receive the chain links thereby providing a uniform tubing shroud along the member.

4. The target as recited in claim 1, further comprising a target element affixed to the vertical member, the target element providing a cross-sectional surface generally larger than a cross-section of the member in combination with the tubing, the element positioned on the member for receiving the object.

5. The target as recited in claim 4, further comprising additional target elements adjustably affixed along portions of the member for defining a target zone.

6. The target as recited in claim 2, further comprising the vertical member having a bottom end opposing the top end, the vertical member having a length dimension sufficient of providing a portion of the chain at the bottom end to contact a surface over which the target is suspended, a sufficient amount of chain portion contacting the surface for providing a damping of the chain after receiving the object thereby further absorbing the energy delivered by the object to the member.

7. The target as recited in claim 5, further comprising multiple elongated vertical members having the additional target elements wherein the elements form a target element array for simulating a target zone.

8. A sports target comprising:

a support;

a pair of elongated spaced apart vertical resilient members each having a top end hingedly affixed to the support for freely suspending each vertical member from the support, each vertical member sufficiently resilient for receiving an object tossed at the member by a player and in combination with the free suspension of the member, absorbing energy of the object for restricting rebounding of the object from the member to a safe position for the player; and a pair of elongated spaced apart generally horizontal members each affixed to the spaced apart vertical members thereby freely suspended from the support through communication with the vertical members, the vertical and horizontal member pairs forming an aperture through which the object can pass, the horizontal members sufficiently rigid in a vertical dimension for holding a fixed shape for an aperture side portion, the horizontal members in combination with the free suspension of each vertical member, sufficiently resilient for receiving the delivered object and absorbing the energy of the object for limiting rebounding of the object from the horizontal member to the safe position.

9. The target as recited in claim 8, further comprising a bag having an opening defined by a perimeter portion of the bag dimensioned to communicate with the aperture, the perimeter portion further having affixing means for attaching the portion to the members for receiving objects passing through the aperture, the bag further dimensioned for storing a multiplicity of objects passing through the aperture.

10. The target as recited in claim 8, wherein the vertical members comprise chain formed from a multiplicity of links.

11. The target as recited in claim 8, further comprising tubing having a bore dimensioned to receive the members and wherein each member is shrouded by the tubing for further absorbing the energy delivered by the object.

12. The target as recited in claim 11, wherein the tubing comprises flexible tube, the tube sufficiently flexible for receiving the object a multiplicity of times thereby providing effective reuse of the object by the player.

13. The target as recited in claim 8, wherein the horizontal members comprise generally flat spring steel rods having a depth dimension substantially smaller than the vertical dimension, the depth dimension providing sufficient flexibility for absorbing the object energy, the spring steel rods having a vertical dimension sufficient for holding the fixed shape of the aperture side portion.

14. The target as recited in claim 11, wherein the flexible tubing comprises tube sections wherein each tube section has a bore dimensioned for closely receiving the members, each section further having a tube wall defining the bore for providing a uniform shroud outer wall along the members.

15. The target as recited in claim 8, wherein the support comprises:

a base; and a support member affixed to the base, the support members dimensioned for receiving and freely suspending the vertical members in a direction toward the player thereby in a generally spaced relation with the support members, the vertical members positioned between the object delivered to the members and the support members, the support members further having a separation dimension proximate a width dimension of the aperture.

16. A low rebound sports target comprising:

a support;

a pair of spaced apart chains formed from a multiplicity of chain links, each chain affixed to the support at a chain top end for freely suspending the chain vertically from the support; and a pair of spaced apart rods affixed proximate each rod end to the chains for forming an aperture dimensioned for receiving an object delivered to the target by a player, wherein chain portions form left and right sides of the aperture and rod portions form top and bottom sides of the aperture.

17. The target as recited in claim 16, further comprising tubing having a bore dimensioned for receiving the chains and the rods, the tubing thereby providing a shroud for receiving objects thrown at the target, the tubing in combination with the freely suspended chains and rods providing visual feedback to the player in response to receiving the object.

18. The target as recited in claim 17, wherein the tubing comprises a material sufficiently flexible for receiving a fast pitch baseball thrown at the target a multiplicity of times for providing extended use of the baseball.

19. The target as recited in claim 17, further comprising a multiplicity of vertically suspended chains and a multiplicity of horizontal rods each rod communicating with the chain links for defining a multiplicity of apertures, further the tubing comprising a multiplicity of tube sections for providing incremental adjustment of each rod with a corresponding chain link along the chain thereby providing adjustable apertures through which apertures the object is delivered during operation of the target.

20. The target as recited in claim 16, further comprising a bag having an opening dimensioned to communicate with the aperture sides for receiving objects passing through the aperture, the opening loosely affixed to the sides, the bag further dimensioned for storing a multiplicity of objects received through the opening.

21. The target as recited in claim 16, further comprising a resilient rubber sheet, the sheet removably affixed to the target for blocking a portion of the aperture thereby reducing an aperture portion available for receiving the object.

22. The target as recited in claim 16, further comprising an elongated resilient rod removably affixed across the aperture for defining aperture sections.

23. The target as recited in claim 16, wherein the tubing has a diameter proximate one inch and each chain and tubing combination is separated by a distance of 21.5 inches from a first chain centerline to a second chain centerline, the chain separation defining an aperture width for communicating with a home plate typically 17 inches wide.

24. The target as recited in claim 16, wherein the support further comprises:

a base; and support members affixed to the base at one end and supporting the chain at another end, the support members dimensioned for receiving and freely suspending the chain in a spaced relation with the support members in a direction toward the player, wherein the chain is positioned between the object tossed at the target and the support members, the support members further having a separation dimension proximate a width dimension of the aperture, whereby the target vertical members generally first receive the objects thereby substantially preventing the objects from directly hitting the support members.

25. The target as recited in claim 24, further comprising a pair of wheels rotatably affixed to the support for moving the target from a first position to alternate positions.

26. A low rebound baseball target assembly comprising:

a base;

a generally parallel pair of elongated spaced apart elongated support members each having a proximal end and a distal end, the proximal end rotatably affixed to the base, whereby the support members are rotatable from a first position extending generally upward from the base during operation of the target, to a second position generally parallel to the base for storing the target, the support members dimensioned for receiving and freely suspending chain in a direction toward a player in a generally spaced relation with the support members, wherein the chain is positioned between a baseball being delivered to the target and the elongated member;

a pair of chains formed from a multiplicity of chain links, each chain affixed to the elongated support member distal end thereby vertically suspending the chain; and a pair of spaced apart rods removably affixed to a chain link at each rod end for forming a target aperture dimensioned for receiving a baseball delivered to the target by a player, wherein chain link portions form left and right sides of the target aperture and rod portions form top and bottom sides of the target aperture, the aperture width defined by a separation distance for the spaced apart chain pair and the aperture height defined by a predetermined number of chain links between the rods.

27. The target assembly as recited in claim 26, further comprising a pair of wheels rotatably affixed to the elongated support members proximal end for rolling the target assembly.

28. The target assembly as recited in claim 26, wherein the elongated support members further comprise concentric tubular portions for telescoping the elongated support members from a first extended position of the target wherein the tubular members place the aperture at a predetermined height, to a second collapsed position wherein the aperture is placed at an alternate height.

29. The target assembly as recited in claim 26, further comprising a bag having an opening dimensioned to communicate with the target aperture thereby receiving baseballs delivered to the target for passing through the aperture, the bag further dimensioned for storing a multiplicity of baseballs received through the opening wherein a storage portion of the bag is positioned generally over the base.

30. The target as recited in claim 26, further comprising the chain pair covered by a multiplicity of rubber tube sections, each chain having an equal number of tube sections for separating a corresponding pair of tube sections on each chain for access to a set of corresponding chain links to which the rod ends are removably affixed, thereby providing incremental locations along the chain pair for affixing the rods, the tube sections further having a bore for closely receiving the chains thereby providing a generally smooth outer tube wall transition from one tube section to an adjacent section thereby providing a generally uniform tube surface for receiving and uniformly rebounding a baseball.

31. The target as recited in claim 26, further comprising:

a horizontal support member affixed to the elongated support member distal ends, the horizontal support member dimensioned for mounting and suspending a screen member having target images; and a screen member having a surface dimensioned for receiving an image of a player, the screen member positioned proximate the aperture; and an image affixed to the screen member.

* * * * *